US010871350B1

(12) United States Patent
Thomas et al.

(10) Patent No.: US 10,871,350 B1
(45) Date of Patent: Dec. 22, 2020

(54) SIGHT MOUNTING SYSTEM FOR A FIREARM

(71) Applicant: NIGHTHAWK CUSTOM LLC, Berryville, AR (US)

(72) Inventors: Daniel Thomas, Harrison, AR (US); Allen Wyatt, Berryville, AR (US)

(73) Assignee: NIGHTHAWK CUSTOM LLC, Berryville, AZ (US)

( * ) Notice: Subject to any disclaimer, the term of this patent is extended or adjusted under 35 U.S.C. 154(b) by 0 days.

(21) Appl. No.: 16/705,781

(22) Filed: Dec. 6, 2019

(51) Int. Cl.
*F41G 11/00* (2006.01)

(52) U.S. Cl.
CPC ..... *F41G 11/001* (2013.01)

(58) Field of Classification Search
CPC combination set(s) only.
See application file for complete search history.

(56) References Cited

U.S. PATENT DOCUMENTS 2,306,972 A * 12/1942 Meisel ..... F41G 11/003 42/125
3,992,783 A * 11/1976 Dunlap ..... F41G 11/003 42/124
4,367,606 A * 1/1983 Bechtel ..... F41G 11/003 42/127
5,570,529 A * 11/1996 Amelino ..... F41G 11/003 42/124
7,578,090 B1 * 8/2009 Romaszka ..... F41C 27/16 42/85
8,650,793 B1 * 2/2014 Mendez ..... F41G 11/003 42/90
2014/0230305 A1 * 8/2014 Zimmer ..... F41C 3/00 42/111
2017/0184375 A1 * 6/2017 Huff ..... F41G 11/001
2017/0261288 A1 * 9/2017 Bartoszewicz ..... F41G 11/003
2018/0195835 A1 * 7/2018 Crispin ..... F41G 1/30
2018/0202770 A1 * 7/2018 Pniel ..... F41G 11/003
2019/0049217 A1 * 2/2019 Costet ..... F41G 1/26
2019/0257620 A1 * 8/2019 Zimmer ..... F41G 11/001
2020/0025520 A1 * 1/2020 Niswander ..... F41G 11/003

* cited by examiner

*Primary Examiner* — Gabriel J. Klein
(74) *Attorney, Agent, or Firm* — Eversheds Sutherland (US) LLP

(57) ABSTRACT

A sight mounting system can include an accessory mounting plate that can be removably coupled to the firearm. The accessory mounting plate can include a mounting slot along a bottom side and an accessory mounting surface along the top side for receiving a removable sight thereon. The accessory mounting surface can include one or more projections that extend up from the mounting surface and one or more threaded apertures extending into the mounting surface for coupling a sight to the plate. The plate can also include an alignment pin cavity extending from one side to the other of the plate and another threaded aperture extending into the top side of the plate. The threaded aperture and the pin cavity can both be in fluid communication with the mounting slot. A pin can be inserted into the pin cavity and pushed into place by a screw through the threaded aperture.

16 Claims, 11 Drawing Sheets

SIGHT MOUNTING SYSTEM FOR A FIREARM

TECHNICAL FIELD

The present disclosure is generally directed to firearms, and more particularly to a sight mounting system for attaching a rear sight to a firearm.

BACKGROUND

Firearms, such as pistols, typically include sights that allow the shooter to accurately fire the weapon. Often, shooters of firearms will use different types of sights in different types of situations. Different sight types of include, but are not limited to, telescopic sights, fixed or adjustable metal sights, optical sights that project a dot in a transparent screen indicating the point of aim of the firearm, and laser sights.

Typically, when a new sight is fitted onto a firearm, the firearm and sight will have to be calibrated so that the point of impact of a bullet leaving the firearm coincides with the point of aim of the new sight. As there can be misalignment issues between newly installed sights and the firearm, the firearm often has to be re-sighted each time a sight is re-mounted to the firearm in order for the firearm to shoot accurately. This process can be very time consuming and can limit the ability of the shooter to be able to switch between sights quickly and easily based upon the shooting environment.

BRIEF DESCRIPTION OF THE SEVERAL VIEWS OF THE DRAWINGS

For a more complete understanding of the present disclosure and certain features thereof, reference is now made to the following description, in conjunction with the accompanying figures briefly described as follows.

DETAILED DESCRIPTION OF THE EXAMPLE EMBODIMENTS

Figure 1A:
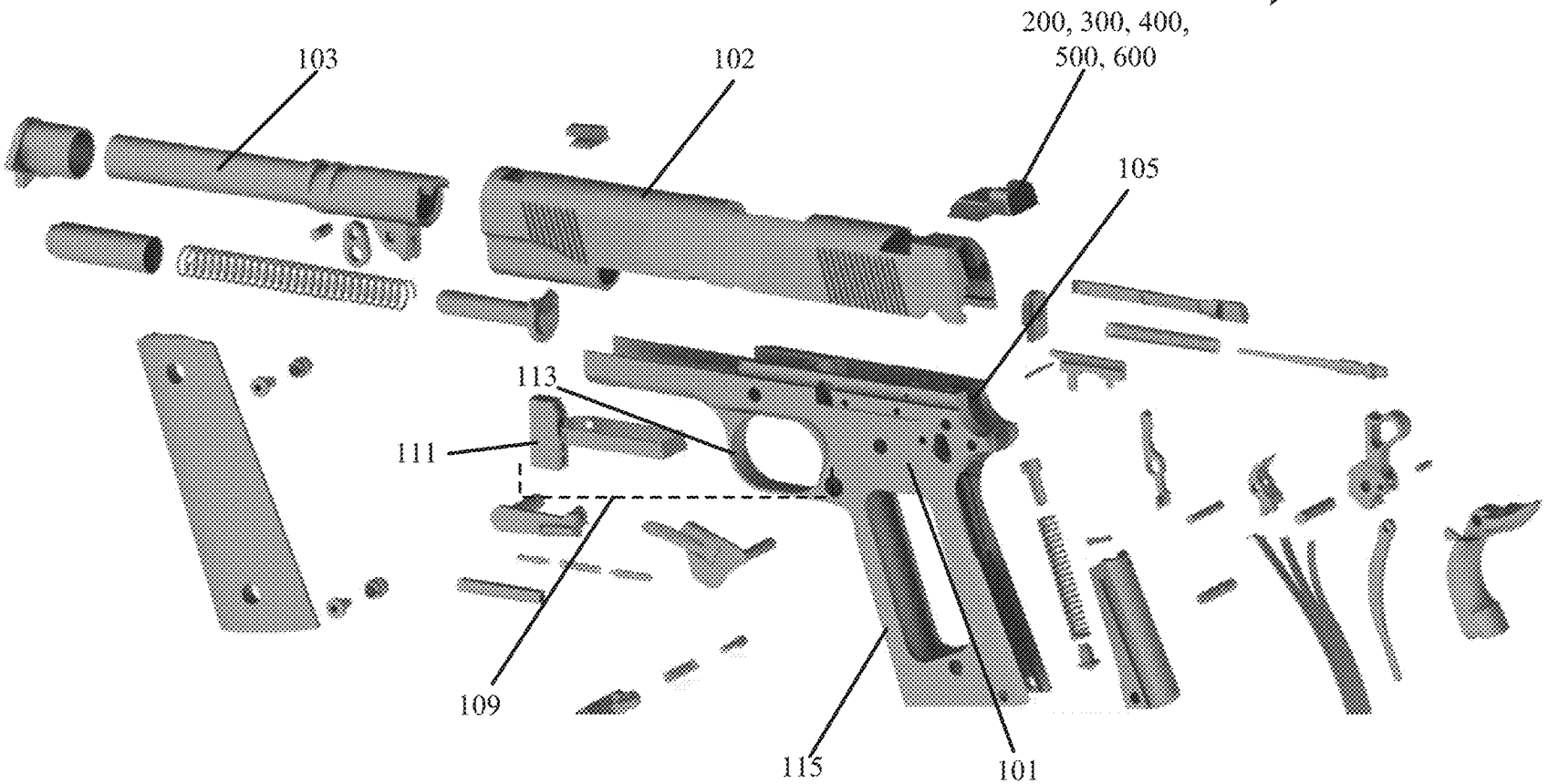
FIG. 1A is an exploded view of a firearm in accordance with example embodiments of the disclosure.

Example embodiments now will be described more fully hereinafter with reference to the accompanying drawings, in which example embodiments are shown. The concepts claimed and described herein may, however, be embodied in many different forms and should not be construed as limited to the example embodiments set forth herein; rather, these embodiments are provided so that this disclosure will be thorough and complete, and will fully convey the scope of the claims to those skilled in the art. Like numbers refer to like, but not necessarily the same, elements throughout.

Certain dimensions and features of the example firearm, firearm slide, and/or sight mounting plate are described herein using the term "approximately." As used herein, the term "approximately" indicates that each of the described dimensions is not a strict boundary or parameter and does not exclude functionally similar variations therefrom. Unless context or the description indicates otherwise, the use of the term "approximately" in connection with a numerical parameter indicates that the numerical parameter includes variations that, using mathematical and industrial principles accepted in the art (e.g., rounding, measurement or other systematic errors, manufacturing tolerances, etc.), would not vary the least significant digit.

In addition, certain relationships are described herein using the term "substantially." As used herein, the terms "substantially" and "substantially equal" indicates that the equal relationship is not a strict relationship and does not exclude functionally similar variations therefrom. Unless context or the description indicates otherwise, the use of the term "substantially" or "substantially equal" in connection with two or more described dimensions or elements indicates that the equal relationship between the dimensions or elements includes variations that, using mathematical and industrial principles accepted in the art (e.g., rounding, measurement or other systematic errors, manufacturing tolerances, etc.), would not vary the least significant digit of the dimensions or elements. As used herein, the term "substantially constant" indicates that the constant relationship is not a strict relationship and does not exclude functionally similar variations therefrom. As used herein, the term "substantially parallel" indicates that the parallel relationship is not a strict relationship and does not exclude functionally similar variations therefrom. As used herein, the term "substantially orthogonal" or "substantially perpendicular" indicates that the orthogonal relationship is not a strict relationship and does not exclude functionally similar variations therefrom It will be understood that, although the terms first, second, etc., may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

Figure 1B:
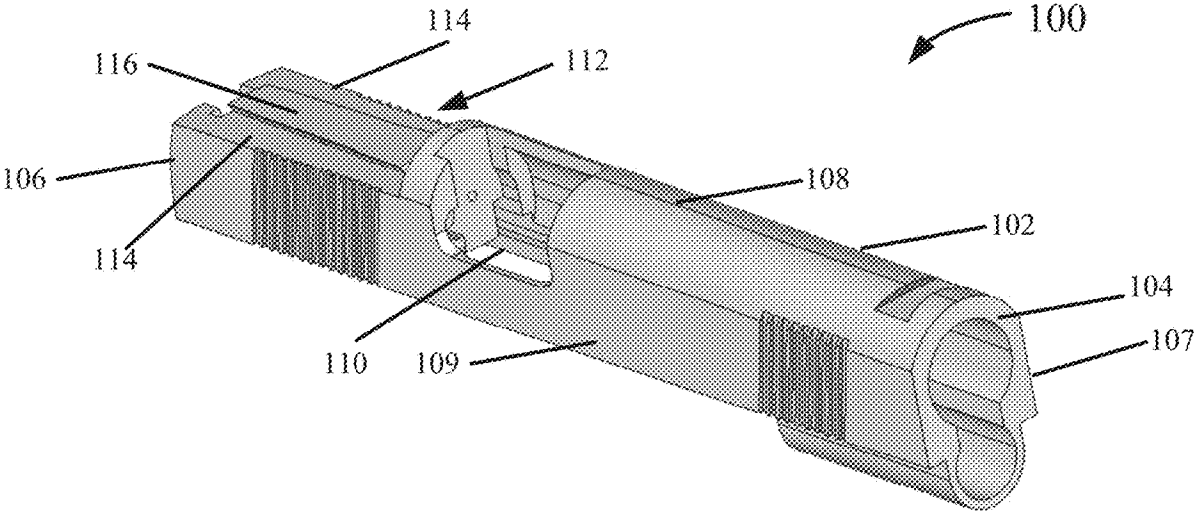
FIGS. 1B and 1C are perspective views of a firearm slide, in accordance with example embodiments of the disclosure.
Figure 1C:
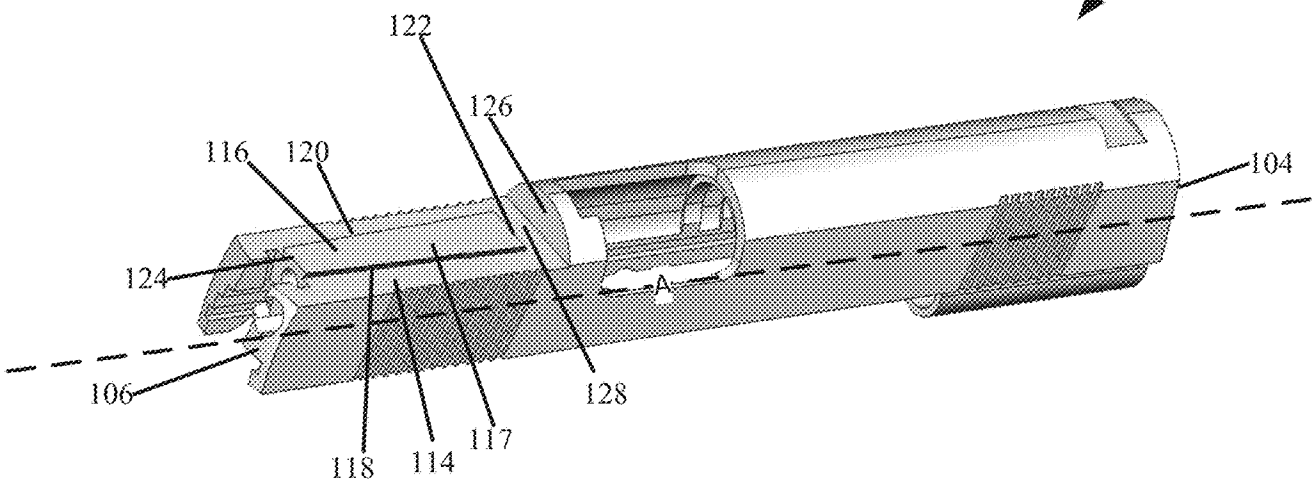

FIG. 1A is an exploded view of a firearm 100 in accordance with one example embodiment of the disclosure. FIGS. 1B and 1C are perspective views of a firearm slide 102 for a firearm 100, in accordance with example embodiments of the disclosure. Now referring to FIGS. 1A-1C, the example firearm 100 can be a pistol. In other example embodiments, the firearm 100 can be any other type of firearm known to those of ordinary skill in the art, including, but not limited to, a rifle, a shotgun, a revolver, or a pistol. Those of ordinary skill in the art will easily recognize that the firearm 100 can include a frame 101 that includes a receiver 105. The pistol can also include a slide 102 and a barrel 103. The firearm 100 can include a number of other components, including the example components shown in FIG. 1A. Those of ordinary skill in the art will recognize that the invention is not limited to the firearm or components shown in FIG. 1A but that the components can be changed, removed, replaced, moved, replaced or otherwise modified depending on the particular design of the firearm 100.

It will be further appreciated that the following description describes example embodiments with sight mounting locations located on the slide 102. However, persons of ordinary skill in the art will appreciate that any sight mounting location, including, but not limited to, on a barrel 103 of the firearm, on the frame 101 of the firearm, or on the top of a receiver 105, can be used to mount the accessory mounting plate of the sight mounting system disclosed herein without departing from the scope and spirit of the present disclosure. In addition, while one example embodiment will be shown and described with reference to the firearm slide 102, in other example embodiments, the firearm may not include a slide and/or the accessory mounting plate 200-600, described below, may be removably coupled to another portion of the firearm.

The frame 101 can include a trigger assembly 109. The trigger assembly 109 can include a trigger 111 and a trigger guard 113. The frame assembly 101 can also include a grip section 115 configured to be gripped by a user of the firearm 100. As discussed above, in certain example embodiments, the frame 101 can also include mounting rail 116 and mounting surface 114 discussed below and can be configured to receive one or more of the accessory mounting plates 200-600 thereon. The slide 102 can accommodate a receiver 105 and a barrel 103. As discussed above, in certain example embodiments, the barrel 103 of the firearm 100, with or without a slide 102, can include the mounting rail 116 and the mounting surface 114 discussed below and can be configured to receive one or more of the accessory mounting plates 200-600 onto the barrel 103 of the firearm.

Any other components known to those of ordinary skill in the art can be constructed with or coupled to the firearm frame 101 or slide 102 to create a completed firearm 100. Such components have not been shown herein in order to better show the relevant portions of the concept described herein. However, each is considered part of the firearm 100 and those of ordinary skill in the art would be capable of selecting the additional components and constructing the firearm 100.

The slide 102 can have a muzzle end 104 along one end of the longitudinal axis A of the slide 102 and a breach end 106 on a second end of the longitudinal axis A of the slide 102. The slide 102 can also include a top surface 108, a first side wall 107, and a second side wall 109 opposite the first side wall. The first side wall 107 and the second side wall 109 can extend from the breech end 106 to the muzzle end 104. The slide 102 can also include an ejection port 110 disposed between the muzzle end 104 and the breech end 106 along the top surface 108 of the slide 102. The ejection port 110 can be an aperture through the top surface 108 and a portion of at least one of the first side wall 107 and the second side wall 109 of the slide 102 that if configured to provide a pathway from an interior of the slide 102 to an exterior of the slide 102 for shell casings discharged by the firearm 100. In certain example embodiments, the slide 102 can also include a front fixed sight 714 (see FIG. 7F). The front fixed sight 714 can be positioned along the top surface 108 of the slide 102 adjacent the muzzle end 104. In other example embodiments, the front fixed sight 714 can be mounted on a barrel 103 in situations where the muzzle end of the barrel 103 is exposed or extends out from the muzzle end 104 of the slide 102.

The slide 102 can also include a sight mount recess 112. In certain example embodiments, the sight mount recess 112 can be disposed between the muzzle end 104 and the breech end 106 of the slide 102. In one example, the sight mount recess 112 can be positioned between the breech end 106 and the ejection port 110. For example, the sight mount recess can be positioned adjacent the breech end 106 of the slide 102. In other example embodiments, the sight mount recess 112 can be positioned along any other portion of the slide 102, including between the muzzle end 104 and the ejection port 110. The sight mount recess 112 can be a cavity or cut-out of the slide 102 and can have a top surface that is below the top surface 108 of the slide 102. The sight mount recess 112 can be configured to receive a sight mount plate and/or sight thereon for coupling to the slide 102.

The sight mount recess 112 can include a sight plate mounting surface 114. In example embodiments where the sight mount recess 112 is positioned between the breech end 106 and the ejection port 110, the sight plate mounting surface 114 can extend from the breech end 106 of the slide to a slide face 126 on the slide 102. In other example embodiments, the sight plate mounting surface 114 can be positioned along any other portion of the slide 102, along a portion of the frame 101, along a portion of the barrel 103, or along a portion of the receiver 105. The sight plate mounting surface 114 can be a flat or substantially flat surface configured to receive a sight mounting plate thereon.

The sight recess 112 can also include a mounting rail 116. The mounting rail 116 can extend up from the sight plate mounting surface 114. In one example embodiment, the mounting rail 116 can extend from the breech end 106 of the slide 102 towards the slide face 126 along the longitudinal axis A of the slide 102. In other example embodiments, the mounting rail 116 can extend along any other portion of the slide 102, along a portion of the frame 101, along a portion of the barrel 103, or along a portion of the receiver 105 of the firearm.

The mounting rail 116 can include a front wall 122, an opposing rear wall 124, a first side wall 118, and an opposing second side wall 120. Each of the front wall 122, rear wall 124, first side wall 118, and second side wall 120 can extend generally vertically upward from the sight plate mounting surface 114. In certain examples, the first side wall 118 and the second side wall 120 can extend up from the sight plate mounting surface 114 at an angle less than or greater than 90 degrees to create a generally V-shaped top edge to each of the first side wall 118 and the second side wall 120 at its respective junction with the top surface 117. In certain example embodiments, the rear wall 124 can be positioned adjacent to the breech end 106 of the slide 102. In other example embodiments, the rear wall 124 can be positioned adjacent the ejection port 110 or any other portion of the slide 102, adjacent a portion of the frame 101, adjacent a portion of the barrel 103, or adjacent a portion of the receiver 105. In one example, a portion 128 of the sight plate mounting surface 114 can extend between the front wall 122 and the slide face 126 of the slide.

The mounting rail 116 can also include a top surface 117 extending between the front wall 122 and the rear wall 124 and between the first side wall 118 and the second side wall 120. In one example embodiment, the top surface 117 can be flat or substantially flat. In other example embodiments, the top surface can have any other type of contour. In certain example embodiments, the top surface 117 of the mounting rail 116 can be positioned below the top surface 108 of the slide 102. The mounting rail 116 can be a dovetail rail (e.g., having cross-section that is in the shape of an inverted trapezium (dovetail)) in certain example embodiments. Alternatively, the mounting rail 116 can be any other type of rail and/or have another cross-sectional shape.

In certain example embodiments, the mounting rail 116 can taper outwards generally from the rear wall 124 to the front wall 122. In other example embodiments, the mounting rail 116 can taper outwards generally from the front wall 122 to the rear wall 124. The tapering effect of the mounting rail 116 can be generated by a tapering of one or both of the first side wall 118 and the second side wall 116 away from or towards the longitudinal axis A of the slide 102. The mounting rail 116 can be configured to engage with a mounting slot of a sight mounting plate and/or sight. For example, a sight mounting plate and/or sight can be slidably coupled to the slide 102 by slidably inserting all or at least a portion of the mounting rail 116 into a mounting slot of the sight mounting plate and/or sight. Each of the mounting rail 116 on the slide 102 and the mounting slot on the sight mounting plate and/or sight can be sized and shaped to create an interference fit when the mounting rail 116 engages the mounting slot. The sliding direction of the sight mounting plate and/or sight onto the slide (or the barrel 103, frame 101, or receiver 105 of the firearm) can be from in either direction with reference to the longitudinal axis of the barrel 103 of the firearm. In certain examples, the sliding direction of the sight mounting plate and/or sight onto the slide can be from the breech end 106 of the slide 102 towards the muzzle end 106 or from the front wall 122 of the mounting rail 116 towards the breech end 106 of the slide 102.

In another example embodiment, the front wall 122 and the rear wall 124 of the mounting rail 116 can taper outwards generally from the first side wall 118 to the second side wall 120. In other example embodiments, the front wall 122 and the rear wall 124 of the mounting rail 116 can taper outwards generally from the second side wall 120 to the first side wall 118. In these examples, the tapering effect of the mounting rail 116 can be generated by a tapering of one or both of the front wall 122 and the rear wall 124 away from or towards one another. In these examples, the sight mounting plate and/or sight can be slidably coupled to the slide 102 (or the barrel 103, frame 101, or receiver 105) by slidably inserting all or at least a portion of the mounting rail 116 into a mounting slot of the sight mounting plate and/or sight from the second side wall 109 of the slide 102 (or a second lateral side of the barrel 103, frame 101, or receiver 105 of the firearm) towards the first side wall 107 (or a first lateral side of the barrel 103, frame 101, or receiver 105 of the firearm) or from the first side wall 107 of the slide 102 (or a first lateral side of the barrel 103, frame 101, or receiver 105 of the firearm) towards the second side wall 109 of the slide 102 (or a second lateral side of the barrel 103, frame 101, or receiver 105 of the firearm).

Figure 2A:
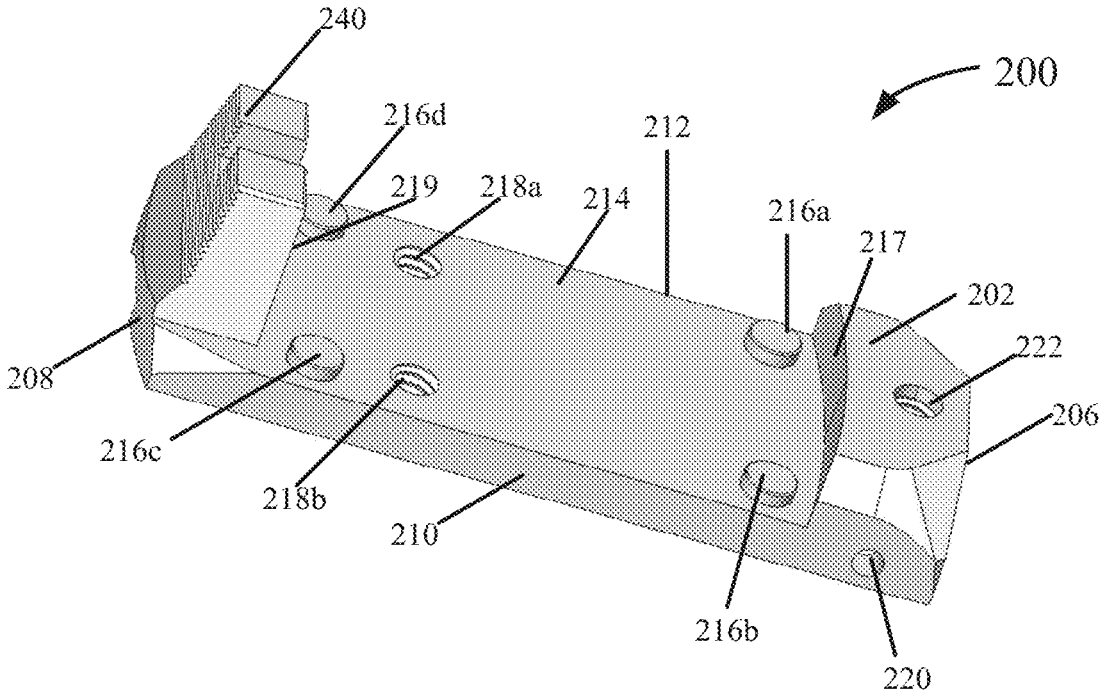
FIGS. 2A-2B are top and bottom perspective views of a sight mounting plate, in accordance with example embodiments of the disclosure.
Figure 2B:
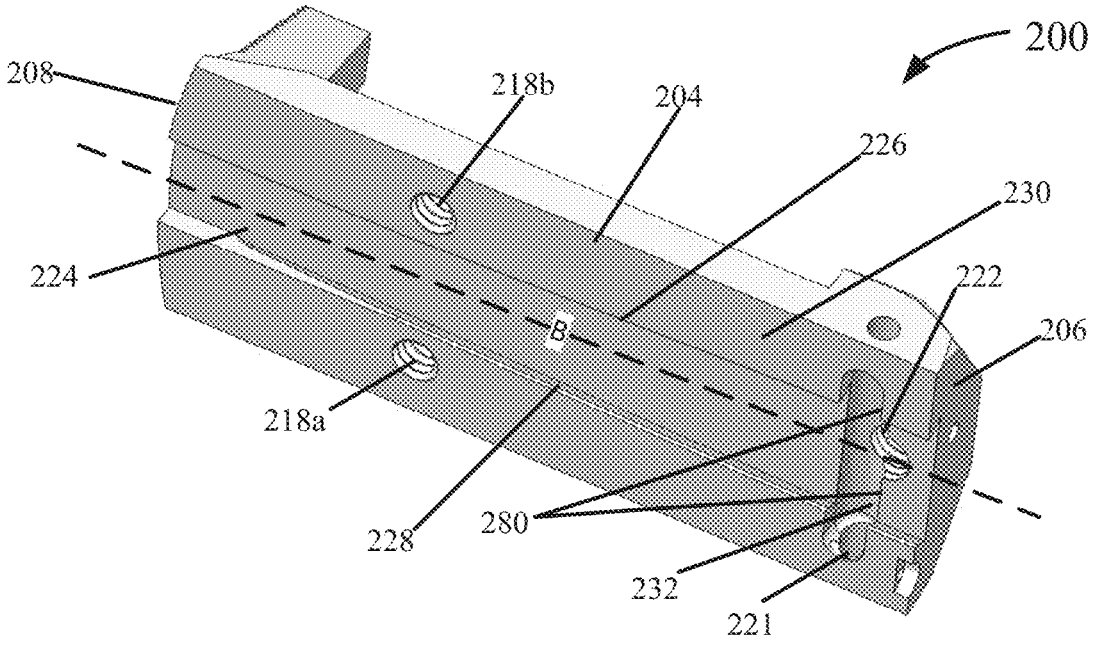

FIGS. 2A-2B are top and bottom perspective views of a sight mounting plate 200, in accordance with example embodiments of the disclosure. In certain example embodiments, the sight mounting plate 200 can be configured to be coupled to the slide 102, barrel 103, frame 101, and/or receiver 105 of the firearm 100 and can be configured to be coupled to a sight. Referring now to FIGS. 1A-2B, the sight mounting plate 200 can include a top side 202 and an opposing bottom side 204. The bottom side 204 can be configured to engage and/or abut the sight plate mounting surface 114 and mounting rail 116 of the slide 102 and the top side 202 can be configured to engage and/or abut a sight coupled to the sight mounting plate 200. The sight mounting plate 200 can also include a front wall 206, an opposing rear wall 208, at least one first side wall 210, and at least one second side wall 212. Each of the at least one first side wall 210 and second side wall 212 can extend from the rear wall 208 to the front wall 206 in certain example embodiments. In addition, each of the front wall 206, rear wall 208, at least one first side wall 210, and at least one second side wall 212 can extending generally vertically upwards from the bottom side 204 to the top side 202 of the sight mounting plate 200.

The top side 202 can include a sight mounting surface 214. The sight mounting surface 214 can be disposed between the front wall 206 and the rear wall 208. The sight mounting plate 200 can include a front sight alignment wall 217 and a rear sight alignment wall 219 that define the sight mounting surface 214. In certain example embodiments, the sight mounting surface 214 can be flat or substantially flat. In other example embodiments, the sight mounting surface 214 can have any other contoured shape.

The sight mounting surface 214 can include one or more mounting projections 216*a-d*. While the example embodiment of FIGS. 2A-2B presents four mounting projections 216*a-d*, that is for example purposes only as the number of mounting projections can be less than or greater than four, including any amount between one and eight. In addition, while the example embodiment of FIGS. 2A-2B shows the mounting projections 216*a-d* configured in a rectangular pattern, this is also for example purposes only as the mounting projections 216*a-d* can be arranged in any other pattern along the sight mounting surface 214. Each mounting projection 216*a-d* can extend generally vertically up from the top surface of the sight mounting surface 214. In one example, each mounting projection 216*a-d* has a cylindrical or substantially cylindrical shape. In other example embodiments, each mounting projection 216*a-d* can be cuboid, spherical, or any other shape. Each mounting projection 216*a-d* can be configured to slidably engage and be received at least partially within a respective alignment aperture provided along a bottom side of a sight to align and couple the sight with respect to the sight mounting plate 200.

The sight mounting surface 214 can also include one or more threaded apertures 218*a*-218*b*. In one example, two threaded apertures 218*a*-218*b* can be provided along the sight mounting surface 214. In other examples, more or less than two threaded apertures 218*a*-218*b* can be provided along the sight mounting surface 214. Each threaded aperture 218*a*-218*b* can be configured to threadably engage a coupling device (e.g., a screw, bolt, etc.) for threadably coupling a sight to the sight mounting plate 200. In certain examples, each threaded aperture 218*a*-218*b* can extend from the top side 202 to the bottom side 204 of the sight mounting plate 200.

The sight mounting plate 200 can also include a fixed rear sight 240. In one example, the fixed rear sight 240 can be positioned adjacent the rear wall 208. In certain examples, the fixed rear sight 240 can extend up from the sight mounting surface 214 and can define the rear sight alignment wall 219. In one example, the fixed rear sight 240 is an iron sight.

The sight mounting plate 200 can also include a threaded aperture 222 along a top side 202 of the sight mounting plate 200. The threaded aperture 222 can be positioned adjacent the front wall 206 and can extend in a direction orthogonal to the longitudinal axis B of the sight mounting plate 200. In certain example embodiments, the threaded aperture 222 is configured to threadably engage a set screw or other coupling device. The sight mounting plate 200 can also include a first pin receiving aperture 220 and a second pin receiving aperture 221. In one example, the first pin receiving aperture 220 is disposed in the first side wall 210 and the second pin receiving aperture 221 is disposed in the second side wall 212. The first pin receiving aperture 220 and the second pin receiving aperture 221 can be fluidicly coupled by an alignment pin cavity 232 disposed along and accessible from a bottom side 204 of the sight mounting plate 200. The alignment pin receiving cavity 232 can extend from the first pin receiving aperture 220 to the second pin receiving aperture 221 and can have a longitudinal axis that is orthogonal or substantially orthogonal to the longitudinal axis B of the sight mounting plate 200. The alignment pin cavity 232 can also be fluidicly coupled to the threaded aperture 222 and the mounting slot 224. The alignment pin apertures 220, 221 and the alignment pin cavity 232 are configured to receive an alignment pin (see FIGS. 7A-7E) therein and therethrough to assist in aligning the sight mounting plate 200 with the slide 102.

The sight mounting plate 200 can also include a mounting surface 230 disposed along the bottom side 204. In certain example embodiments, the mounting surface 230 can be flat or substantially flat. In other examples, the mounting surface 230 can have any other profile or surface texture. The mounting surface 230 can extend from the front wall 206 to the rear wall 208 in certain example embodiments. The mounting surface 230 can be configured to engage and abut the sight plate mounting surface 114 on the slide 102 when the sight mounting plate 200 is coupled to the slide 102. In one example, the mounting surface 230 can be bisected by a mounting slot 224 that divides the mounting surface 230 into two separate mounting surfaces.

The mounting slot 224 can disposed along the bottom side 204 of the sight mounting plate 200. The mounting slot 224 can extend up or inward from the mounting surface 230. In one example embodiment, the mounting slot 224 can extend from the rear wall 208 towards and/or to the front wall 206 or the alignment pin cavity 232 along the longitudinal axis B of the sight mounting plate 200. The mounting slot 224 can include a first side wall 226, and an opposing second side wall 228. Each of the first side wall 226 and second side wall 228 can extend generally vertically upward from the mounting surface 230 along the bottom side 204. In one example, the first side wall 226 and the second side wall 228 can be disposed at angles complementary to the first side wall 118 and second side wall 120 of the mounting rail 116. For example, the first side wall 226 and the second side wall 228 can complement a dovetail rail (e.g., having cross-section that is in the shape of an inverted trapezium (dovetail)) and can be V-shaped or substantially V-shaped with the top wall of the mounting slot 224. Alternatively, the first side wall 226 and the second side wall 228 can complement any other cross-sectional shape of the mounting rail 116.

In certain example embodiments, the side walls 226, 228 of the mounting slot 224 can taper outwards generally from the rear wall 208 towards the front wall 206. In other example embodiments, the side walls 226, 228 of the mounting slot 224 can taper outwards generally from the front wall 206 to the rear wall 208. The tapering effect of the mounting slot 224 can be generated by a tapering of one or both of the first side wall 226 and the second side wall 228 away from or towards the longitudinal axis B of the sight mounting plate 200. The mounting slot 224 can be configured to slidably receive therein all or a portion of the mounting rail 116. For example, the sight mounting plate 200 can be slidably coupled to the slide 102 by slidably inserting all or at least a portion of the mounting rail 116 into a mounting slot 224. Each of the mounting rail 116 on the slide 102 and the mounting slot 224 on the sight mounting plate 200 can be sized and shaped to create an interference fit when the mounting rail 116 engages the mounting slot 224. The sliding direction of the sight mounting plate 200 onto the slide 102 can be from the breech end 106 of the slide 102 towards the muzzle end 106 or from the front wall 122 of the mounting rail 116 towards the breech end 106 of the slide 102.

In another example embodiment, instead of having a first side wall 226 and a second side wall 228, the mounting slot 224 can include a front wall and a rear wall that define the mounting slot 224. The front wall and the rear wall can extend from the first side wall 210 to or towards the second side wall 212 or from the second side wall 212 to or towards the first side wall 210 in a direction that is generally orthogonal to the longitudinal axis B of the sight mounting plate 200. In this example, the front wall and the rear wall of the mounting slot 224 can taper outwards generally from the first side wall 210 to or towards the second side wall 212. In other example embodiments, the front wall and the rear wall of the mounting slot 224 can taper outwards generally from the second side wall 212 to or towards the first side wall 210. In these examples, the taper of the mounting slot 224 can be generated by a tapering of one or both of the front wall and the rear wall away from or towards one another. In these examples, the sight mounting plate 200 can be slidably coupled to the slide 102 by slidably inserting all or at least a portion of the mounting rail 116 into the mounting slot 224 from the second side wall 109 of the slide 102 towards the first side wall 107 or from the first side wall 107 of the slide 102 towards the second side wall 109 of the slide 102.

Figure 3A:
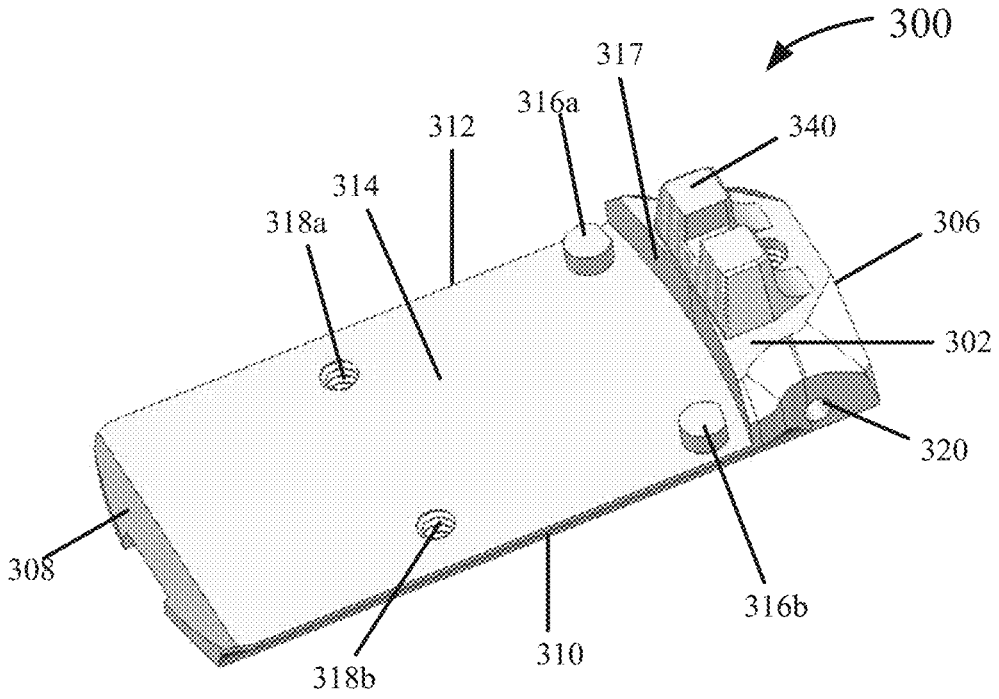
FIGS. 3A-3B are top and bottom perspective views of another sight mounting plate, in accordance with example embodiments of the disclosure.
Figure 3B:
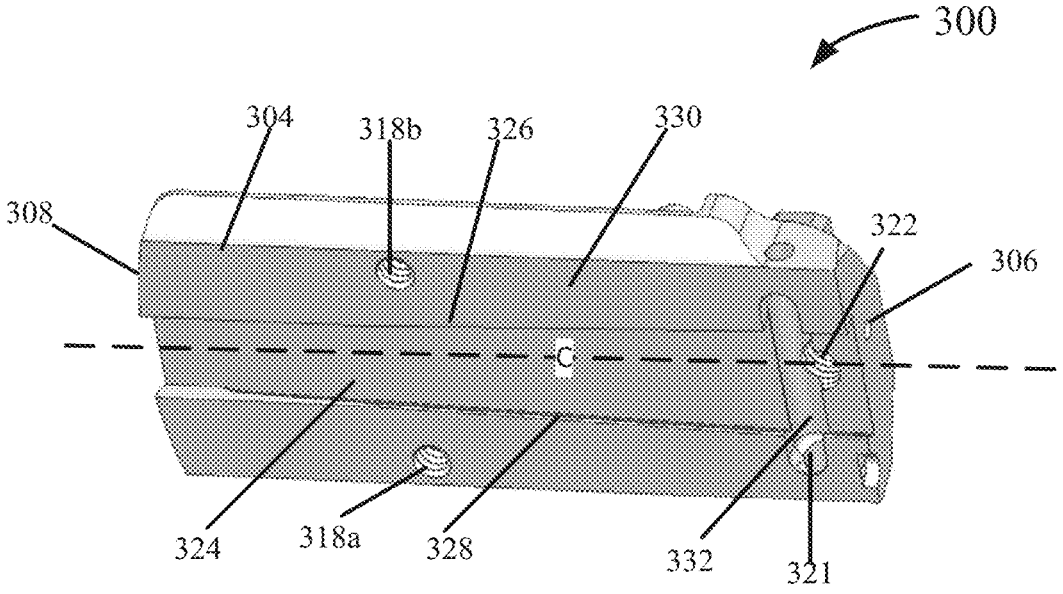

FIGS. 3A-3B are top and bottom perspective views of another sight mounting plate 300, in accordance with example embodiments of the disclosure. The sight mounting plate 300 can be configured to be coupled to the slide 102, frame 101, barrel 103, and/or receiver 105 of the firearm 100 and can be configured to be coupled to a sight. Referring now to FIGS. 1A-1C and 3A-3B, the sight mounting plate 300 can include a top side 302 and an opposing bottom side 304. The bottom side 304 can be configured to engage and/or abut the sight plate mounting surface 114 and mounting rail 116 of the slide 102 and the top side 302 can be configured to engage and/or abut a sight coupled to the sight mounting plate 300. The sight mounting plate 300 can also include a front wall 306, an opposing rear wall 308, at least one first side wall 310, and at least one second side wall 312. Each of the at least one first side wall 310 and second side wall 312 can extend from the rear wall 308 to the front wall 306 in certain example embodiments. In addition, each of the front wall 306, rear wall 308, at least one first side wall 310, and at least one second side wall 312 can extending generally vertically upwards from the bottom side 304 to the top side 302 of the sight mounting plate 300.

The top side 302 can include a sight mounting surface 314. The sight mounting surface 314 can be disposed between the front wall 306 and the rear wall 308. The sight mounting plate 300 can include a front sight alignment wall 317 to assist in aligning a sight on the sight mounting surface 314. In certain example embodiments, the sight mounting surface 314 can be flat or substantially flat. In other example embodiments, the sight mounting surface 314 can have any other contoured shape or texture.

The sight mounting surface 314 can include one or more mounting projections 316*a-b*. While the example embodiment of FIGS. 3A-3B presents two mounting projections 316*a-b*, that is for example purposes only as the number of mounting projections can be less than or greater than two, including any amount between one and eight. In addition, while the example embodiment of FIGS. 3A-3B shows the mounting projections 316*a-b* configured in a linear pattern adjacent the front sight alignment wall 317, this is also for example purposes only as the mounting projections 316*a-b* can be arranged in any other pattern along the sight mounting surface 314. Each mounting projection 316*a-b* can extend generally vertically up from the top surface of the sight mounting surface 314. In one example, each mounting projection 316*a-b* has a cylindrical or substantially cylindrical shape. In other example embodiments, each mounting projection 316*a-b* can be cuboid, spherical, or any other shape. Each mounting projection 316*a-b* can be configured to slidably engage and be received at least partially within a respective alignment aperture provided along a bottom side of a sight to align and couple the sight with respect to the sight mounting plate 300.

The sight mounting surface 314 can also include one or more threaded apertures 318*a-b*. In one example, two threaded apertures 318*a-b* can be provided along the sight mounting surface 314. In other examples, more or less than two threaded apertures 318*a-b* can be provided along the sight mounting surface 314. Each threaded aperture 318*a-b* can be configured to threadably engage a coupling device (e.g., a screw, bolt, etc.) for threadably coupling a sight to the sight mounting plate 300. In certain examples, each threaded aperture 318*a-b* can extend from the top side 302 to the bottom side 304 of the sight mounting plate 300.

The sight mounting plate 300 can also include a fixed rear sight 340. In one example, the fixed rear sight 340 can be positioned between the front wall 306 and the sight mounting surface 314. In certain examples, the fixed rear sight 340 can extend up from the sight mounting surface 314 and can define the front sight alignment wall 317. In one example, the fixed rear sight 340 is an iron sight.

The sight mounting plate 300 can also include a threaded aperture 322 along a top side 302 of the sight mounting plate 300. The threaded aperture 322 can be positioned adjacent the front wall 306 and can extend in a direction orthogonal to the longitudinal axis C of the sight mounting plate 300. In certain example embodiments, the threaded aperture 322 is configured to threadably engage a set screw or other coupling device. The sight mounting plate 300 can also include a first pin receiving aperture 320 and a second pin receiving aperture 321. In one example, the first pin receiving aperture 320 is disposed in the first side wall 310 and the second pin receiving aperture 321 is disposed in the second side wall 312. The first pin receiving aperture 320 and the second pin receiving aperture 321 can be fluidicly coupled by an alignment pin cavity 332 disposed along and accessible from a bottom side 304 of the sight mounting plate 300. The alignment pin receiving cavity 332 can extend from the first pin receiving aperture 320 to the second pin receiving aperture 321 and can have a longitudinal axis that is orthogonal or substantially orthogonal to the longitudinal axis C of the sight mounting plate 300. The alignment pin cavity 332 can also be fluidicly coupled to the threaded aperture 322 and the mounting slot 324. The alignment pin apertures 320, 321 and the alignment pin cavity 332 are configured to receive an alignment pin (see FIGS. 7A-7E) therein and therethrough to assist in aligning the sight mounting plate 300 with the slide 102.

The sight mounting plate 300 can also include a mounting surface 330 disposed along the bottom side 304. In certain example embodiments, the mounting surface 330 can be flat or substantially flat. In other examples, the mounting surface 330 can have any other profile or surface texture. The mounting surface 330 can extend from the front wall 306 to the rear wall 308 in certain example embodiments. The mounting surface 330 can be configured to engage and abut the sight plate mounting surface 114 on the slide 102 when the sight mounting plate 300 is coupled to the slide 102. In one example, the mounting surface 330 can be bisected by a mounting slot 324 that divides the mounting surface 330 into two separate mounting surfaces.

The mounting slot 324 can disposed along the bottom side 304 of the sight mounting plate 300. The mounting slot 324 can extend up or inward from the mounting surface 330. In one example embodiment, the mounting slot 324 can extend from the rear wall 308 towards and/or to the front wall 306 or the alignment pin cavity 332 along the longitudinal axis C of the sight mounting plate 300. The mounting slot 324 can include a first side wall 326, and an opposing second side wall 328. Each of the first side wall 326 and second side wall 328 can extend generally vertically upward from the mounting surface 330 along the bottom side 304. In one example, the first side wall 326 and the second side wall 328 can be disposed at angles complementary to the first side wall 118 and second side wall 120 of the mounting rail 116. For example, the first side wall 326 and the second side wall 328 can complement a dovetail rail (e.g., having cross-section that is in the shape of an inverted trapezium (dovetail)) and can be V-shaped or substantially V-shaped with the top wall of the mounting slot 324. Alternatively, the first side wall 326 and the second side wall 328 can complement any other cross-sectional shape of the mounting rail 116.

In certain example embodiments, the side walls 326, 328 of the mounting slot 324 can taper outwards generally from the rear wall 308 towards the front wall 306. In other example embodiments, the side walls 326, 328 of the mounting slot 324 can taper outwards generally from the front wall 306 to the rear wall 308. The tapering effect of the side walls 326, 328 of the mounting slot 324 can be generated by a tapering of one or both of the first side wall 326 and the second side wall 328 away from or towards the longitudinal axis C of the sight mounting plate 300. The mounting slot 324 can be configured to slidably receive therein all or a portion of the mounting rail 116. For example, the sight mounting plate 300 can be slidably coupled to the slide 102 by slidably inserting all or at least a portion of the mounting rail 116 into a mounting slot 324. Each of the mounting rail 116 on the slide 102 and the mounting slot 324 on the sight mounting plate 300 can be sized and shaped to create an interference fit when the mounting rail 116 engages the mounting slot 324. The sliding direction of the sight mounting plate 300 onto the slide 102 can be from the breech end 106 of the slide 102 towards the muzzle end 106 or from the front wall 122 of the mounting rail 116 towards the breech end 106 of the slide 102.

In another example embodiment, instead of having a first side wall 326 and a second side wall 328, the mounting slot 324 can include a front wall and a rear wall that define the mounting slot 324. The front wall and the rear wall can extend from the first side wall 310 to or towards the second side wall 312 or from the second side wall 312 to or towards the first side wall 310 in a direction that is generally orthogonal to the longitudinal axis C of the sight mounting plate 300. In this example, the front wall and the rear wall of the mounting slot 324 can taper outwards generally from the first side wall 310 to or towards the second side wall 312. In other example embodiments, the front wall and the rear wall of the mounting slot 324 can taper outwards generally from the second side wall 312 to or towards the first side wall 310. In these examples, the tapering effect of the mounting slot 324 can be generated by a tapering of one or both of the front wall and the rear wall away from or towards one another. In these examples, the sight mounting plate 300 can be slidably coupled to the slide 102 by slidably inserting all or at least a portion of the mounting rail 116 into the mounting slot 324 from the second side wall 109 of the slide 102 towards the first side wall 107 or from the first side wall 107 of the slide 102 towards the second side wall 109 of the slide 102.

Figure 4A:
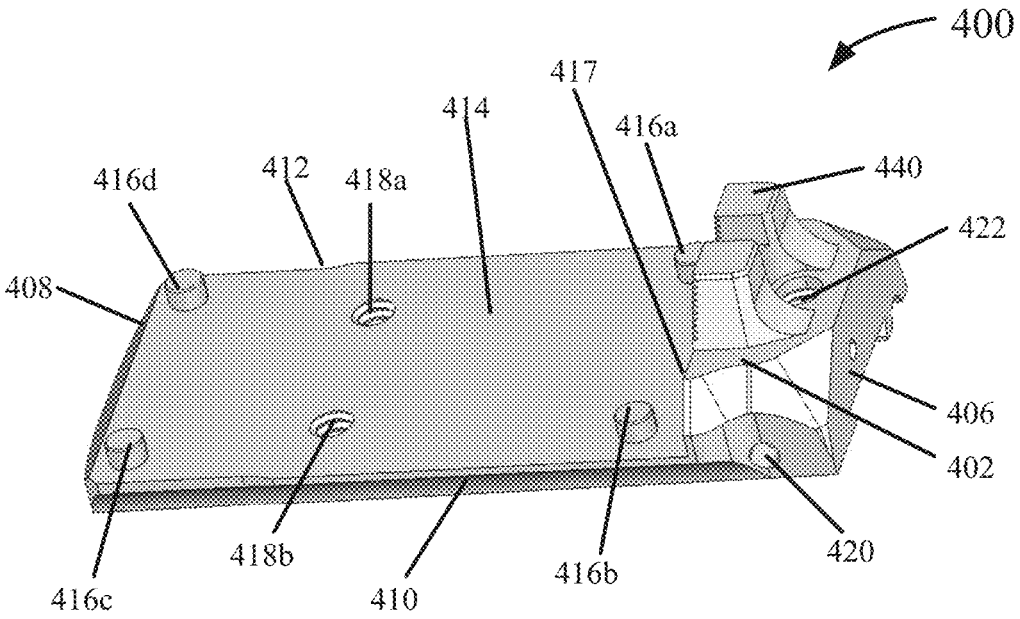
FIGS. 4A-4B are top and bottom perspective views of yet another sight mounting plate, in accordance with example embodiments of the disclosure.
Figure 4B:
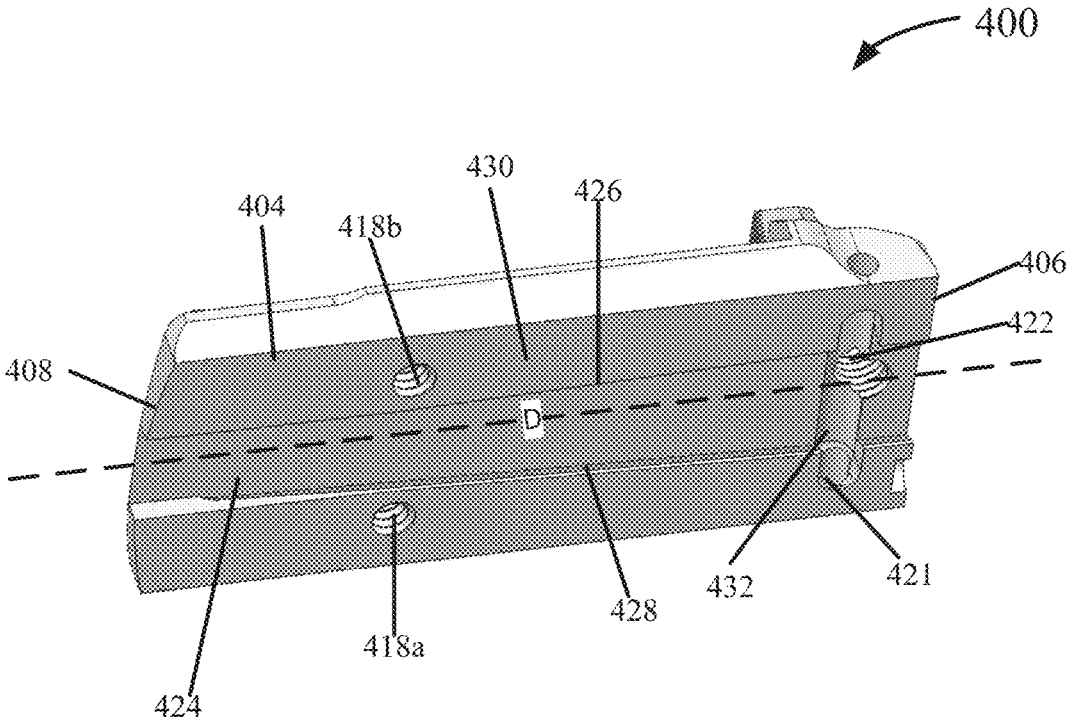

FIGS. 4A-4B are top and bottom perspective views of another sight mounting plate 400, in accordance with example embodiments of the disclosure. The sight mounting plate 400 can be configured to be coupled to the slide 102, frame 101, barrel 103, and/or receiver 105 of the firearm 100 and can be configured to be coupled to a sight. Referring now to FIGS. 1A-1C and 4A-4B, the sight mounting plate 400 can include a top side 402 and an opposing bottom side 404. The bottom side 404 can be configured to engage and/or abut the sight plate mounting surface 114 and mounting rail 116 of the slide 102 and the top side 402 can be configured to engage and/or abut a sight coupled to the sight mounting plate 400. The sight mounting plate 400 can also include a front wall 406, an opposing rear wall 408, at least one first side wall 410, and at least one second side wall 412. Each of the at least one first side wall 410 and second side wall 412 can extend from the rear wall 408 to the front wall 406 in certain example embodiments. In addition, each of the front wall 406, rear wall 408, at least one first side wall 410, and at least one second side wall 412 can extending generally vertically upwards from the bottom side 404 to the top side 402 of the sight mounting plate 400.

The top side 402 can include a sight mounting surface 414. The sight mounting surface 414 can be disposed between the front wall 406 and the rear wall 408. The sight mounting plate 400 can include a front sight alignment wall 417 to assist in aligning a sight on the sight mounting surface 414. In certain example embodiments, the sight mounting surface 414 can be flat or substantially flat. In other example embodiments, the sight mounting surface 414 can have any other contoured shape or texture.

The sight mounting surface 414 can include one or more mounting projections 416*a-d*. While the example embodiment of FIGS. 4A-4B presents four mounting projections 416*a-d*, that is for example purposes only as the number of mounting projections can be less than or greater than four, including any amount between one and eight. In addition, while the example embodiment of FIGS. 4A-4B shows the mounting projections 416*a-d* configured in a rectangular pattern, this is also for example purposes only as the mounting projections 416*a-d* can be arranged in any other pattern along the sight mounting surface 414. Each mounting projection 416*a-d* can extend generally vertically up from the top surface of the sight mounting surface 414. In one example, each mounting projection 416*a-d* has a cylindrical or substantially cylindrical shape. In other example embodiments, each mounting projection 416*a-d* can be cuboid, spherical, or any other shape. Each mounting projection 416*a-d* can be configured to slidably engage and be received at least partially within a respective alignment aperture provided along a bottom side of a sight to align and couple the sight with respect to the sight mounting plate 400.

The sight mounting surface 414 can also include one or more threaded apertures 418*a-b*. In one example, two threaded apertures 418*a-b* can be provided along the sight mounting surface 414. In other examples, more or less than two threaded apertures 418*a-b* can be provided along the sight mounting surface 414. Each threaded aperture 418*a-b* can be configured to threadably engage a coupling device (e.g., a screw, bolt, etc.) for threadably coupling a sight to the sight mounting plate 400. In certain examples, each threaded aperture 418*a-b* can extend from the top side 402 to the bottom side 404 of the sight mounting plate 400.

The sight mounting plate 400 can also include a fixed rear sight 440. In one example, the fixed rear sight 440 can be positioned between the front wall 406 and the sight mounting surface 414. In certain examples, the fixed rear sight 340 can extend up from the sight mounting surface 414 and can define the front sight alignment wall 417. In one example, the fixed rear sight 440 is an iron sight.

The sight mounting plate 400 can also include a threaded aperture 422 along a top side 402 of the sight mounting plate 400. The threaded aperture 422 can be positioned adjacent the front wall 406 and can extend in a direction orthogonal to the longitudinal axis D of the sight mounting plate 400. In certain example embodiments, the threaded aperture 422 is configured to threadably engage a set screw or other coupling device. The sight mounting plate 400 can also include a first pin receiving aperture 420 and a second pin receiving aperture 421. In one example, the first pin receiving aperture 420 is disposed in the first side wall 410 and the second pin receiving aperture 421 is disposed in the second side wall 412. The first pin receiving aperture 420 and the second pin receiving aperture 421 can be fluidicly coupled by an alignment pin cavity 432 disposed along and accessible from a bottom side 404 of the sight mounting plate 400. The alignment pin receiving cavity 432 can extend from the first pin receiving aperture 420 to the second pin receiving aperture 421 and can have a longitudinal axis that is orthogonal or substantially orthogonal to the longitudinal axis D of the sight mounting plate 400. The alignment pin cavity 432 can also be fluidicly coupled to the threaded aperture 422 and the mounting slot 424. The alignment pin apertures 420, 421 and the alignment pin cavity 432 are configured to receive an alignment pin (see FIGS. 7A-7E) therein and therethrough to assist in aligning the sight mounting plate 400 with the slide 102.

The sight mounting plate 400 can also include a mounting surface 430 disposed along the bottom side 404. In certain example embodiments, the mounting surface 430 can be flat or substantially flat. In other examples, the mounting surface 430 can have any other profile or surface texture. The mounting surface 430 can extend from the front wall 406 to the rear wall 408 in certain example embodiments. The mounting surface 430 can be configured to engage and abut the sight plate mounting surface 114 on the slide 102 when the sight mounting plate 400 is coupled to the slide 102. In one example, the mounting surface 430 can be bisected by a mounting slot 424 that divides the mounting surface 430 into two separate mounting surfaces.

The mounting slot 424 can disposed along the bottom side 404 of the sight mounting plate 400. The mounting slot 424 can extend up or inward from the mounting surface 430. In one example embodiment, the mounting slot 424 can extend from the rear wall 408 towards and/or to the front wall 406 or the alignment pin cavity 432 along the longitudinal axis D of the sight mounting plate 400. The mounting slot 424 can include a first side wall 426, and an opposing second side wall 428. Each of the first side wall 426 and second side wall 428 can extend generally vertically upward from the mounting surface 430 along the bottom side 404. In one example, the first side wall 426 and the second side wall 428 can be disposed at angles complementary to the first side wall 118 and second side wall 120 of the mounting rail 116. For example, the first side wall 426 and the second side wall 428 can complement a dovetail rail (e.g., having cross-section that is in the shape of an inverted trapezium (dovetail)) and can be V-shaped or substantially V-shaped with the top wall of the mounting slot 424. Alternatively, the first side wall 426 and the second side wall 428 can complement any other cross-sectional shape of the mounting rail 116.

In certain example embodiments, the side walls 426, 428 of the mounting slot 424 can taper outwards generally from the rear wall 408 towards the front wall 406. In other example embodiments, the side walls 426, 428 of the mounting slot 424 can taper outwards generally from the front wall 406 to the rear wall 408. The tapering effect of the mounting slot 424 can be generated by a tapering of one or both of the first side wall 426 and the second side wall 428 away from or towards the longitudinal axis D of the sight mounting plate 400. The mounting slot 424 can be configured to slidably receive therein all or a portion of the mounting rail 116. For example, the sight mounting plate 400 can be slidably coupled to the slide 102 by slidably inserting all or at least a portion of the mounting rail 116 into a mounting slot 424. Each of the mounting rail 116 on the slide 102 and the mounting slot 424 on the sight mounting plate 400 can be sized and shaped to create an interference fit when the mounting rail 116 engages the mounting slot 424. The sliding direction of the sight mounting plate 400 onto the slide 102 can be from the breech end 106 of the slide 102 towards the muzzle end 106 or from the front wall 122 of the mounting rail 116 towards the breech end 106 of the slide 102.

In another example embodiment, instead of having a first side wall 426 and a second side wall 428, the mounting slot 424 can include a front wall and a rear wall that define the mounting slot 424. The front wall and the rear wall can extend from the first side wall 410 to or towards the second side wall 412 or from the second side wall 412 to or towards the first side wall 410 in a direction that is generally orthogonal to the longitudinal axis D of the sight mounting plate 400. In this example, the front wall and the rear wall of the mounting slot 424 can taper outwards generally from the first side wall 410 to or towards the second side wall 412. In other example embodiments, the front wall and the rear wall of the mounting slot 424 can taper outwards generally from the second side wall 412 to or towards the first side wall 410. In these examples, the tapering effect of the mounting slot 424 can be generated by a tapering of one or both of the front wall and the rear wall away from or towards one another. In these examples, the sight mounting plate 400 can be slidably coupled to the slide 102 by slidably inserting all or at least a portion of the mounting rail 116 into the mounting slot 424 from the second side wall 109 of the slide 102 towards the first side wall 107 or from the first side wall 107 of the slide 102 towards the second side wall 109 of the slide 102.

Figure 5:
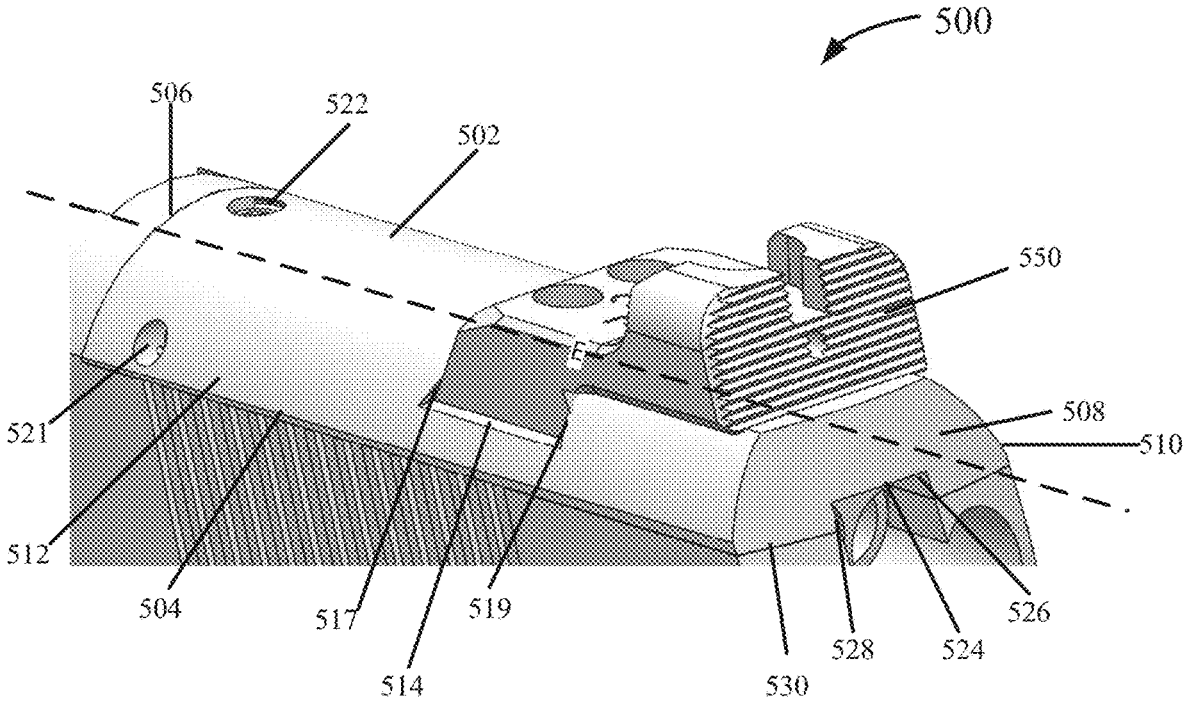
FIG. 5 is a perspective view of another sight mounting plate, in accordance with example embodiments of the disclosure.

FIG. 5 is a top perspective view of another sight mounting plate 500 coupled to a slide 102 of a firearm 100, in accordance with example embodiments of the disclosure. FIG. 5 also shows an example sight 550 mounted to the sight mounting plate 500. Referring now to FIGS. 1A-1C and 5, the sight mounting plate 500 can include a top side 502 and an opposing bottom side 504. The bottom side 504 can be configured to engage and/or abut the sight plate mounting surface 114 and mounting rail 116 of the slide 102, frame 101, barrel 103, and/or receiver 105 of the firearm. The top side 502 can be configured to engage and/or abut a sight 550 coupled to the sight mounting plate 500. The sight mounting plate 500 can also include a front wall 506, an opposing rear wall 508, at least one first side wall 510, and at least one second side wall 512. Each of the at least one first side wall 510 and second side wall 512 can extend from the rear wall 508 to the front wall 506 in certain example embodiments.

The top side 502 can include a sight mounting surface 514. The sight mounting surface 514 can be disposed between the front wall 506 and the rear wall 508. The sight mounting plate 500 can include a front sight alignment wall 517 and a rear sight alignment wall 519 that define the sight mounting surface 514 and assist in aligning a sight 550 on the sight mounting surface 514. In certain example embodiments, the sight mounting surface 514 can be flat or substantially flat. In other example embodiments, the sight mounting surface 514 can have any other contoured shape or texture.

The sight mounting surface 514 can also include one or more threaded apertures (not shown but substantially the same as the apertures 418*a-b* of FIGS. 4A-B). In one example, two threaded apertures can be provided along the sight mounting surface 514. In other examples, more or less than two threaded apertures can be provided along the sight mounting surface 514. Each threaded aperture can be configured to threadably engage a coupling device (e.g., a screw, bolt, etc.) for threadably coupling a sight 550 to the sight mounting plate 500. In certain examples, each threaded aperture can extend from the top side 502 to the bottom side 504 of the sight mounting plate 500.

The sight mounting plate 500 can also include a threaded aperture 522 along a top side 502 of the sight mounting plate 500. The threaded aperture 522 can be positioned adjacent the front wall 506 and can extend in a direction orthogonal to the longitudinal axis E of the sight mounting plate 500. In certain example embodiments, the threaded aperture 522 is configured to threadably engage a set screw or other coupling device. The sight mounting plate 500 can also include a first pin receiving aperture (not shown but substantially the same as the first pin receiving aperture 420 of FIGS. 4A-B) and a second pin receiving aperture 521. In one example, the first pin receiving aperture is disposed in the first side wall 510 and the second pin receiving aperture 521 is disposed in the second side wall 512. The first pin receiving aperture and the second pin receiving aperture 521 can be fluidicly coupled by an alignment pin cavity (not shown but substantially the same as the alignment pin receiving cavity 432 of FIGS. 4A-B) disposed along and accessible from a bottom side 504 of the sight mounting plate 500. The alignment pin receiving cavity can extend from the first pin receiving aperture to the second pin receiving aperture 521 and can have a longitudinal axis that is orthogonal or substantially orthogonal to the longitudinal axis E of the sight mounting plate 500. The alignment pin cavity can also be fluidicly coupled to the threaded aperture 522 and the mounting slot (not shown but substantially the same as the mounting slot 424 of FIGS. 4A-B). The alignment pin apertures 421 and the alignment pin cavity are configured to receive an alignment pin (see FIGS. 7A-7E) therein and therethrough to assist in aligning the sight mounting plate 500 with the slide 102.

The sight mounting plate 500 can also include a mounting surface 530 disposed along the bottom side 504. In certain example embodiments, the mounting surface 530 can be flat or substantially flat. In other examples, the mounting surface 530 can have any other profile or surface texture. The mounting surface 530 can extend from the front wall 506 to the rear wall 508 in certain example embodiments. The mounting surface 530 can be configured to engage and abut the sight plate mounting surface 114 on the slide 102 when the sight mounting plate 500 is coupled to the slide 102. In one example, the mounting surface 530 can be bisected by a mounting slot 524 that divides the mounting surface 530 into two separate mounting surfaces.

The mounting slot 524 can disposed along the bottom side 504 of the sight mounting plate 500. The mounting slot 524 can extend up or inward from the mounting surface 530. In one example embodiment, the mounting slot 524 can extend from the rear wall 508 towards and/or to the front wall 506 or the alignment pin cavity along the longitudinal axis E of the sight mounting plate 500. The mounting slot 524 can include a first side wall 526, and an opposing second side wall 528. Each of the first side wall 526 and second side wall 528 can extend generally vertically upward from the mounting surface along the bottom side 504. In one example, the first side wall 526 and the second side wall 528 can be disposed at angles complementary to the first side wall 118 and second side wall 120 of the mounting rail 116. For example, the first side wall 526 and the second side wall 528 can complement a dovetail rail (e.g., having cross-section that is in the shape of an inverted trapezium (dovetail)) and can be V-shaped or substantially V-shaped with the top wall of the mounting slot 524. Alternatively, the first side wall 526 and the second side wall 528 can complement any other cross-sectional shape of the mounting rail 116.

In certain example embodiments, the side walls 526, 528 of the mounting slot 524 can taper outwards generally from the rear wall 508 towards the front wall 506. In other example embodiments, the side walls 526, 528 of the mounting slot 524 can taper outwards generally from the front wall 506 to the rear wall 508. The tapering of the mounting slot 524 can be generated by a tapering of one or both of the first side wall 526 and the second side wall 528 away from or towards the longitudinal axis E of the sight mounting plate 500. The mounting slot 524 can be configured to slidably receive therein all or a portion of the mounting rail 116. For example, the sight mounting plate 500 can be slidably coupled to the slide 102 by slidably inserting all or at least a portion of the mounting rail 116 into a mounting slot 524. Each of the mounting rail 116 on the slide 102 and the mounting slot 524 on the sight mounting plate 500 can be sized and shaped to create an interference fit when the mounting rail 116 engages the mounting slot 524. The sliding direction of the sight mounting plate 500 onto the slide 102 can be from the breech end 106 of the slide 102 towards the muzzle end 106 or from the front wall 122 of the mounting rail 116 towards the breech end 106 of the slide 102.

In another example embodiment, instead of having a first side wall and a second side wall, the mounting slot 524 can include a front wall and a rear wall that define the mounting slot 524. The front wall and the rear wall can extend from the first side wall 510 to or towards the second side wall 512 or from the second side wall 512 to or towards the first side wall 510 in a direction that is generally orthogonal to the longitudinal axis E of the sight mounting plate 500. In this example, the front wall and the rear wall of the mounting slot can taper outwards generally from the first side wall 510 to or towards the second side wall 512. In other example embodiments, the front wall and the rear wall of the mounting slot can taper outwards generally from the second side wall 512 to or towards the first side wall 510. In these examples, the tapering effect of the mounting slot can be generated by a tapering of one or both of the front wall and the rear wall away from or towards one another. In these examples, the sight mounting plate 500 can be slidably coupled to the slide 102 by slidably inserting all or at least a portion of the mounting rail 116 into the mounting slot from the second side wall 109 of the slide 102 towards the first side wall 107 or from the first side wall 107 of the slide 102 towards the second side wall 109 of the slide 102.

Figure 6A:
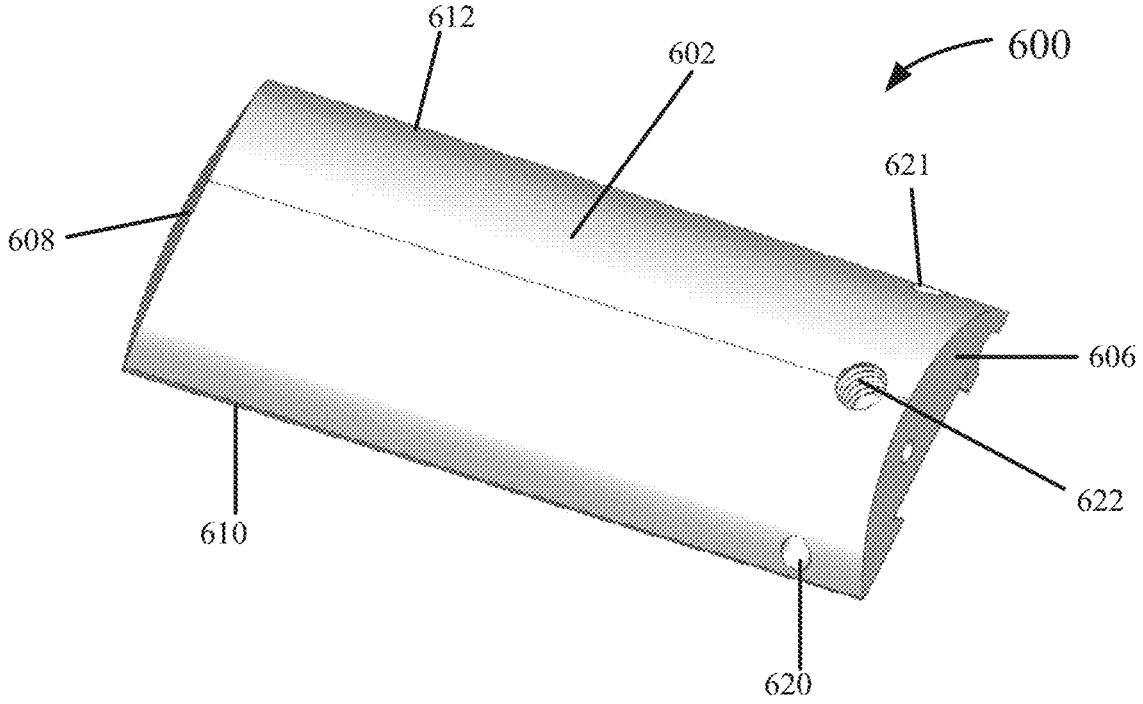
FIGS. 6A-6B are top and bottom perspective views of still another sight mounting plate, in accordance with example embodiments of the disclosure.
Figure 6B:
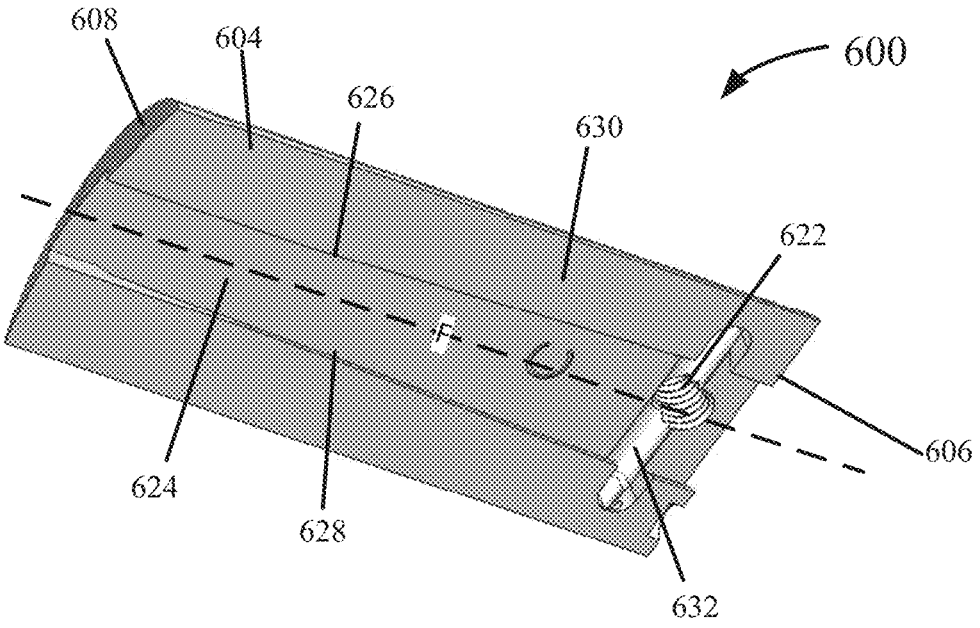

FIGS. 6A-6B are top and bottom perspective views of another sight mounting plate 600, in accordance with example embodiments of the disclosure. The sight mounting plate 600 can be configured to be coupled to the slide 102, frame 101, barrel 103, and/or receiver 105 of the firearm 100 when another sight will not be coupled to the sight mounting plate 600 to cover the sight mount recess 112. Referring now to FIGS. 1A-1C and 6A-6B, the sight mounting plate 600 can include a top side 602 and an opposing bottom side 604. The bottom side 604 can be configured to engage and/or abut the sight plate mounting surface 114 and mounting rail 116 of the slide 102. The sight mounting plate 600 can also include a front wall 606, an opposing rear wall 608, at least one first side wall 610, and at least one second side wall 612. Each of the at least one first side wall 610 and second side wall 612 can extend from the rear wall 608 to the front wall 606 in certain example embodiments. In addition, each of the front wall 606, rear wall 608, at least one first side wall 610, and at least one second side wall 612 can extending generally up from the bottom side 604.

The top side 602 can include a curved top surface or another contour to generally match the contour of the top surface 108 of the slide 102. The sight mounting plate 600 can also include a threaded aperture 622 along a top side 602 of the sight mounting plate 600. The threaded aperture 622 can be positioned adjacent the front wall 606 and can extend in a direction orthogonal to the longitudinal axis F of the sight mounting plate 600. In certain example embodiments, the threaded aperture 622 is configured to threadably engage a set screw or other coupling device. The sight mounting plate 600 can also include a first pin receiving aperture 620 and a second pin receiving aperture 621. In one example, the first pin receiving aperture 620 is disposed adjacent the first side wall 610 and the second pin receiving aperture 621 is disposed adjacent the second side wall 612. The first pin receiving aperture 620 and the second pin receiving aperture 621 can be fluidicly coupled by an alignment pin cavity 632 disposed along and accessible from a bottom side 604 of the sight mounting plate 600. The alignment pin receiving cavity 632 can extend from the first pin receiving aperture 620 to the second pin receiving aperture 621 and can have a longitudinal axis that is orthogonal or substantially orthogonal to the longitudinal axis F of the sight mounting plate 600. The alignment pin cavity 632 can also be fluidicly coupled to the threaded aperture 622 and the mounting slot 624. The alignment pin apertures 620, 621 and the alignment pin cavity 632 are configured to receive an alignment pin (see FIGS. 7A-7E) therein and therethrough to assist in aligning the sight mounting plate 600 with the slide 102.

The sight mounting plate 600 can also include a mounting surface 630 disposed along the bottom side 604. In certain example embodiments, the mounting surface 630 can be flat or substantially flat. In other examples, the mounting surface 630 can have any other profile or surface texture. The mounting surface 630 can extend from the front wall 606 to the rear wall 608 in certain example embodiments. The mounting surface 630 can be configured to engage and abut the sight plate mounting surface 114 on the slide 102 when the sight mounting plate 600 is coupled to the slide 102. In one example, the mounting surface 630 can be bisected by a mounting slot 624 that divides the mounting surface 630 into two separate mounting surfaces.

The mounting slot 624 can disposed along the bottom side 604 of the sight mounting plate 600. The mounting slot 624 can extend up or inward from the mounting surface 630. In one example embodiment, the mounting slot 624 can extend from the rear wall 608 towards and/or to the front wall 606 or the alignment pin cavity 632 along the longitudinal axis F of the sight mounting plate 600. The mounting slot 624 can include a first side wall 626, and an opposing second side wall 628. Each of the first side wall 626 and second side wall 628 can extend generally vertically upward from the mounting surface 630 along the bottom side 604. In one example, the first side wall 626 and the second side wall 628 can be disposed at angles complementary to the first side wall 118 and second side wall 120 of the mounting rail 116. For example, the first side wall 626 and the second side wall 628 can complement a dovetail rail (e.g., having cross-section that is in the shape of an inverted trapezium (dovetail)) and can be V-shaped or substantially V-shaped with the top wall of the mounting slot 624. Alternatively, the first side wall 626 and the second side wall 628 can complement any other cross-sectional shape of the mounting rail 116.

In certain example embodiments, the side walls 626, 628 of the mounting slot 624 can taper outwards generally from the rear wall 608 towards the front wall 606. In other example embodiments, the side walls 626, 628 of the mounting slot 624 can taper outwards generally from the front wall 606 to the rear wall 608. The tapering effect of the mounting slot 624 can be generated by a tapering of one or both of the first side wall 626 and the second side wall 628 away from or towards the longitudinal axis F of the sight mounting plate 600. The mounting slot 624 can be configured to slidably receive therein all or a portion of the mounting rail 116. For example, the sight mounting plate 600 can be slidably coupled to the slide 102 by slidably inserting all or at least a portion of the mounting rail 116 into a mounting slot 624. Each of the mounting rail 116 on the slide 102 and the mounting slot 624 on the sight mounting plate 600 can be sized and shaped to create an interference fit when the mounting rail 116 engages the mounting slot 624. The sliding direction of the sight mounting plate 600 onto the slide 102 can be from the breech end 106 of the slide 102 towards the muzzle end 106 or from the front wall 122 of the mounting rail 116 towards the breech end 106 of the slide 102.

In another example embodiment, instead of having a first side wall 626 and a second side wall 628, the mounting slot 624 can include a front wall and a rear wall that define the mounting slot 624. The front wall and the rear wall can extend from the first side wall 610 to or towards the second side wall 612 or from the second side wall 612 to or towards the first side wall 610 in a direction that is generally orthogonal to the longitudinal axis F of the sight mounting plate 600. In this example, the front wall and the rear wall of the mounting slot 624 can taper outwards generally from the first side wall 610 to or towards the second side wall 612. In other example embodiments, the front wall and the rear wall of the mounting slot 624 can taper outwards generally from the second side wall 612 to or towards the first side wall 610. In these examples, the tapering effect of the mounting slot 624 can be generated by a tapering of one or both of the front wall and the rear wall away from or towards one another. In these examples, the sight mounting plate 600 can be slidably coupled to the slide 102 by slidably inserting all or at least a portion of the mounting rail 116 into the mounting slot 624 from the second side wall 109 of the slide 102 towards the first side wall 107 or from the first side wall 107 of the slide 102 towards the second side wall 109 of the slide 102.

While different forms of the sight mounting plate 200-600 have been shown and described with reference to FIGS. 2A-6B, these sight mounting plates are provided for example only, as the claimed sight mounting plates can take other shapes and have additional or different features and/or a rearrangement of those features than those described in the example sight mounting plates 200-600 above. The sight mounting plates 200-600 can be configured to be coupled to the slide 102, frame 101, barrel 103, and/or receiver 105 of the firearm 100 without the use of a screw or other threaded coupling device that directly couples the sight mounting plate 200-600 to the slide 102, frame 101, barrel 103, and/or receiver 105. The method of coupling the sight mounting plates 200-600 herein instead can provide a more accurate and consistent way to align a sight coupled to the sight mounting plate 200-600 to the slide 102, frame 101, barrel 103, and/or receiver 105. In addition, it provides a way to leave the sight coupled to the sight mounting plate 200-600 while still being able to detach and/or attach the sight mounting plate 200-600 to the slide 102, frame 101, barrel 103, and/or receiver 105 of the firearm 100. The ability to leave the sight attached to the sight mounting plate 200-600 while attaching and/or detaching the sight mounting plate 200-600 from the slide 102, frame 101, barrel 103, and/or receiver 105 reduces and/or eliminates the need to re-aim the sight on the firearm 100 when the sight mounting plate 200-600 (and sight) are reattached to the slide 102, frame 101, barrel 103, and/or receiver 105.

FIGS. 7A-7F are schematic illustrations presenting a method for attaching a sight 712 and sight mounting plate 200-600 to a slide 102 of a firearm 100, in accordance with example embodiments of the disclosure. While the example embodiment of FIGS. 7A-7F will be described with reference to the sight mounting plate 500, it should be understood that any sight mounting plate having the mounting slot for coupling to the mounting rail 116 may be substituted for the sight mounting plate 500. Further, while the example in FIGS. 7A-7F is described with reference to attaching the sight mounting plate to a slide 102 of the firearm 100 this is for example purposes only as the sight mounting plate can alternatively be attached to the barrel 103, frame 101, and/or receiver 105 of the firearm in other example embodiments. As such, each of the frame 101, barrel 103, and/or receiver 105 of the firearm may be substituted for each reference to the slide 102 below. In addition, while not shown in FIGS. 7A-7E, in certain example embodiments, the sight 712 can be already coupled to the sight mounting plate 200-600 before the sight mounting plate 200-600 is coupled to or decoupled from the slide 102, frame 101, barrel 103, and/or receiver 105.

Figure 7A:
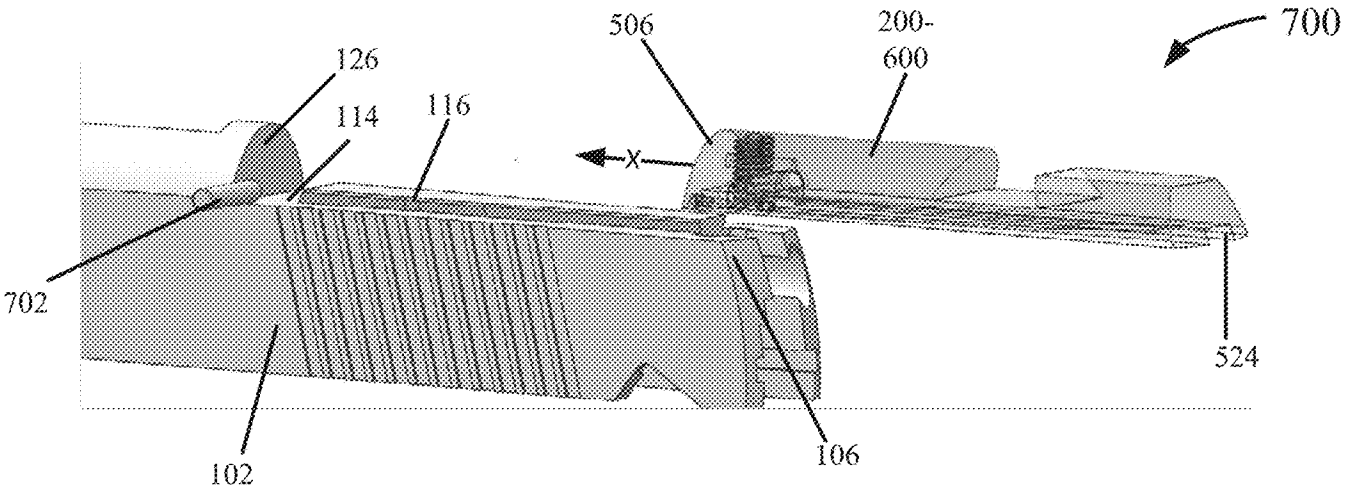
FIGS. 7A-7F are schematic illustrations presenting a method for attaching a sight to a slide of a firearm, in accordance with example embodiments of the disclosure.

Referring now to FIGS. 1A-7F, as best shown in FIG. 7A, the sight mounting plate 200-600 can be coupled to the slide 102, frame 101, barrel 103, and/or receiver 105. In certain example embodiments, the sight mounting plate 200-600 can be slidably coupled to the slide 102, frame 101, barrel 103, and/or receiver 105. In one example, the sight mounting plate 200-600 can be positioned adjacent the breech end 106 of the slide 102 and moved in the direction X to insert the mounting rail 116 into the mounting slot 524 as the mounting surface 530 moves along the site plate mounting surface 114 on the slide 102. As such, the sight mounting plate 200-600 can be slid onto the slide 102 from the breech end 106 of the slide 102. In another example, as discussed above, the sight mounting plate 200-600 can be positioned adjacent the slide face 126 at the front end of the sight mounting recess 112 or along another portion of the slide 102 (e.g., when the mounting rail is positioned between the ejection port 110 and the muzzle end 108 of the slide 102). The sight mounting plate 200-600 can then be slid in the direction opposite X to insert the mounting rail 116 into the mounting slot 524 as the mounting surface 530 moves along the sight plate mounting surface 114 on the slide 102. As such, the sight mounting plate 200-600 can be slid onto the slide 102 from the front to back and starting near the front wall 122 of the mounting rail 116. In yet another example embodiment, as discussed above, the sight mounting plate 200-600 can be positioned adjacent the first side wall 107 of the slide 102 alongside the sight mounting recess 112. The sight mounting plate 200-600 can then be slid in a direction orthogonal to X to insert the mounting rail 116 into the mounting slot 524 as the mounting surface 530 moves along the sight plate mounting surface 114 on the slide 102. As such, the sight mounting plate can be slidably coupled to the slide 102 from a first side of the slide 102 and sliding in a direction orthogonal to the longitudinal axis of the slide 102. In still another example embodiment, as discussed above, the sight mounting plate 200-600 can be positioned adjacent the second side wall 109 of the slide 102 alongside the sight mounting recess 112. The sight mounting plate 200-600 can then be slid in a direction orthogonal to X to insert the mounting rail 116 into the mounting slot 524 as the mounting surface 530 moves along the sight plate mounting surface 114 on the slide 102. As such, the sight mounting plate can be slidably coupled to the slide 102 from a second side of the slide 102 and sliding in a direction orthogonal to the longitudinal axis of the slide 102. The interaction of the mounting rail 116 and the mounting slot 524 can be a friction fit and can be generated based on the tapered shape of the side walls of the mounting rail 116 and the mounting slot 524.

Figure 7B:
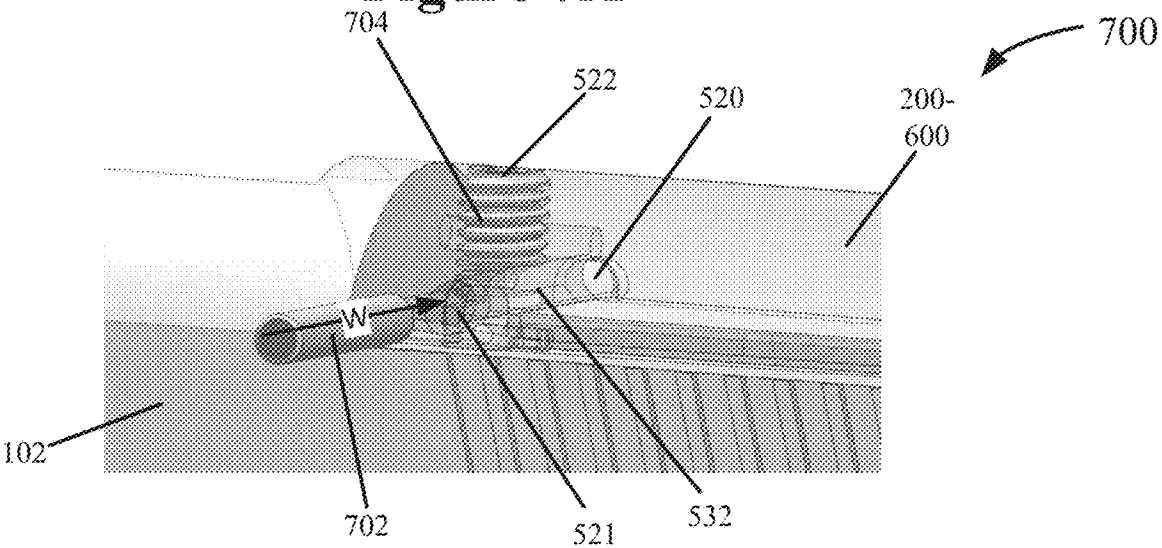
Figure 7C:
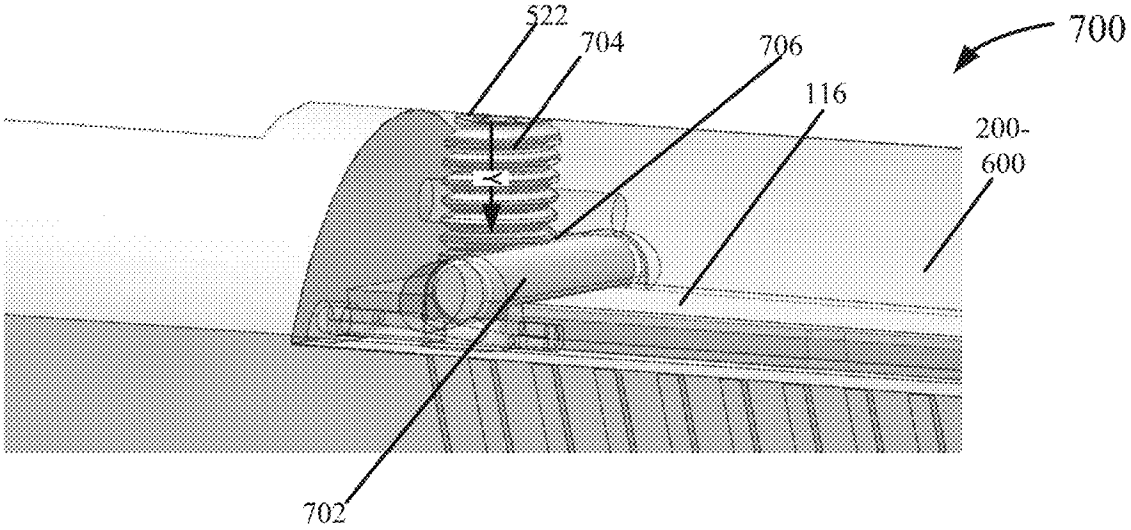

As best seen in FIGS. 7B-7C, once the mounting rail 116 has been inserted into the mounting slot 524 with the front wall 506 of the sight mounting plate 200-600 being positioned adjacent to the slide face 126 of the sight mount recess 112, an alignment pin 702 can be inserted through one of the pin receiving apertures 520, 521 (for example in the direction W or in the direction opposite W, each of which can be orthogonal or substantially orthogonal to the longitudinal axis A of the slide 102) and into the alignment pin cavity 532. In one example, the alignment pin 702 can have a cylindrical or substantially cylindrical shape. In other example embodiments, the alignment pin 702 can have another shape, including, but not limited to, conical, frustoconical, cuboid, etc. In certain example embodiments, the alignment pin 702 can only be inserted into the alignment pin cavity 532 once at least a portion of the alignment pin cavity 535 is positioned forward of the front wall 122 of the mounting rail 116.

Figure 7D:
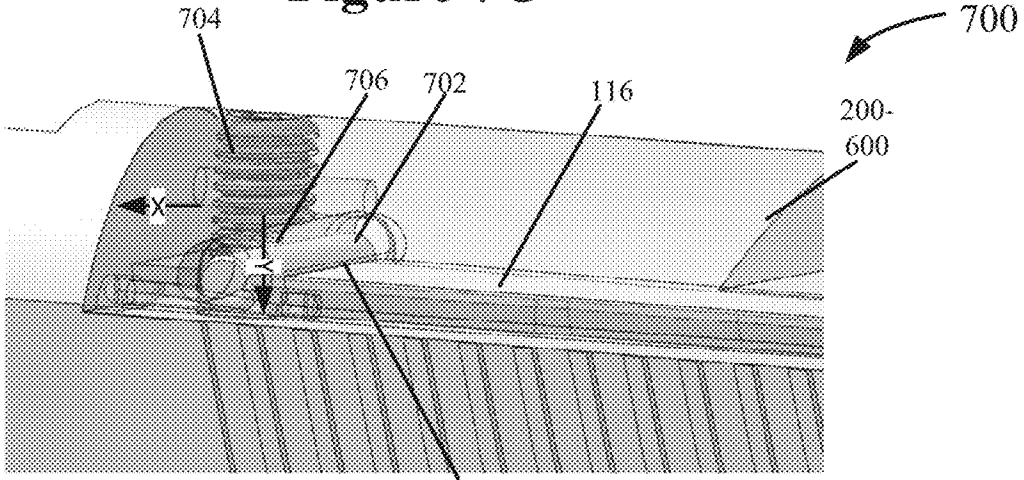
Figure 7E:
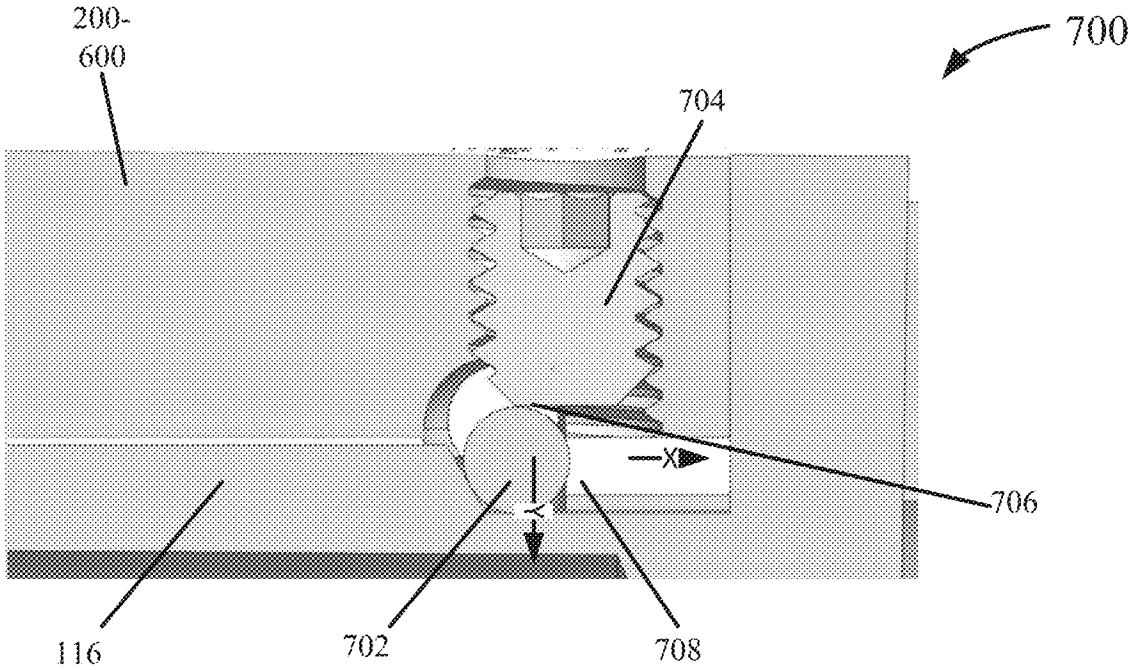

The sight mounting plate 200-600 can include a set screw 704 or other threaded coupling device (e.g., screw, bolt, etc.) in the threaded aperture 522 or one can be threadably inserted into the threaded aperture 522. As best shown in FIGS. 7C-7E, the set screw 704 or other threaded coupling device can be threadably tightened in the threaded aperture 522. As the set screw 704 or other threaded coupling device is tightened, it moves in the direction Y. The bottom 706 of the set screw 704 or other threaded coupling device contacts the alignment pin 702 and forces the alignment pin 702 downward in the direction Y. The alignment pin 702 under force of the set screw 704 or other threaded coupling device is forced to move down in between the front wall 122 of the mounting rail 116 and an interior wall 708 of the alignment pin cavity 532. The pinching of the alignment pin 702 between the front wall 122 of the mounting rail 116 and the interior wall 708 of the alignment pin cavity 532 applies a force to move the sight mounting plate 200-600 further in the direction X (based on the pin 702 pushing against the interior wall 708 of the alignment pin cavity 532) and also forces the sight mounting plate 200-600 in the direction opposite Y (based on the set screw 704 or other threaded coupling device being unable to move further down in the direction Y once the alignment pin 702 contacts the set screw 704, the front wall 122 of the mounting rail 116, and the inside wall 280 of the sight mounting plate 200-600), to tighten the sight mounting plate 200-600 on the slide 102 and ensure consistent positioning of the sight mounting plate 200-600 on the sight mount recess 112 of the slide 102.

Figure 7F:
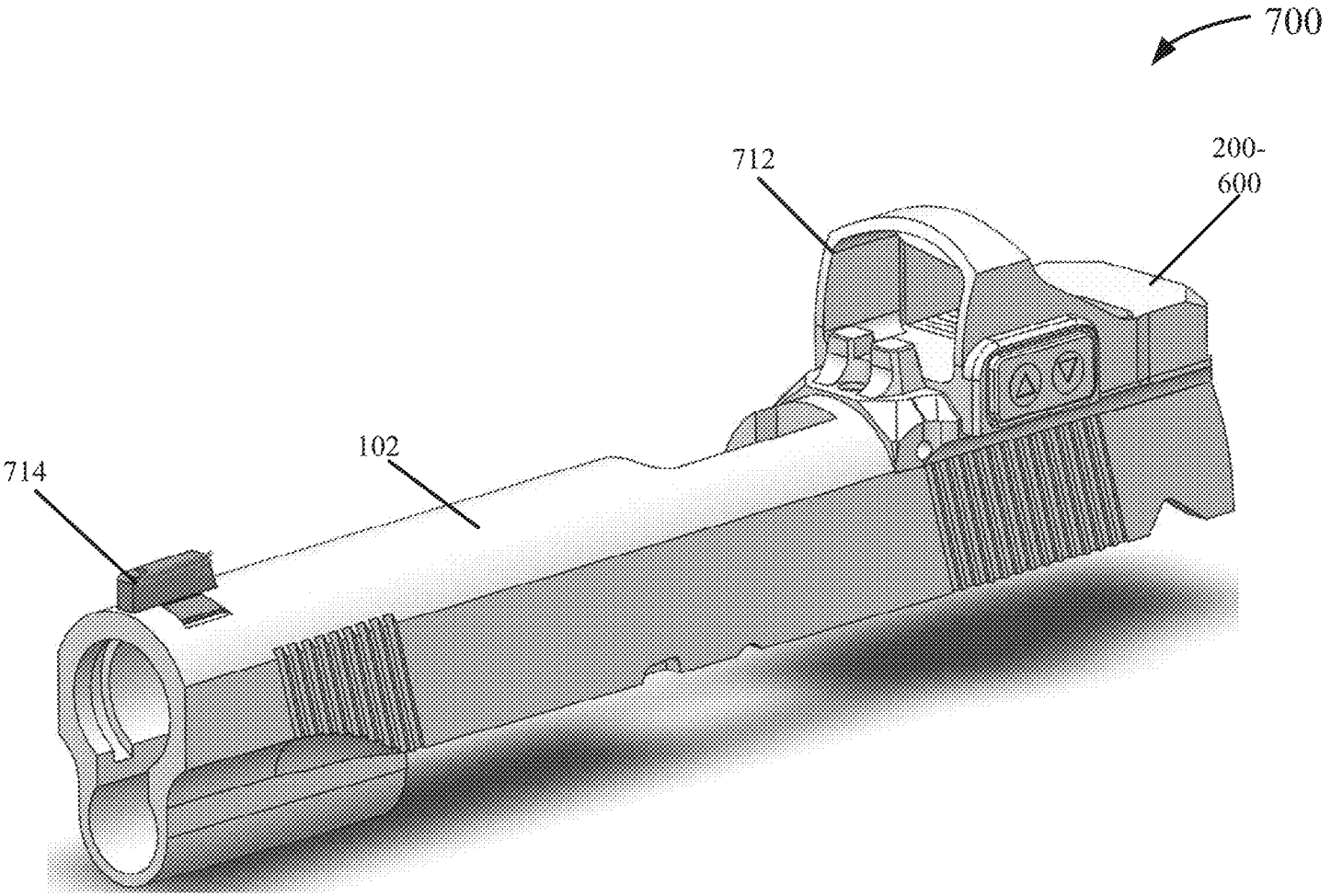

As best shown in FIG. 7F, if not yet coupled, a sight 712 can be coupled to the sight mounting plate 200-600. The sight 712 can be any type of sight configured to be attached to a firearm 100, including, but not limited to an optical sight, such as a Trijicon RMR or a Leopold Data Point, RMSc Shield, or other sights that project a light image on a display screen at the point of aim of the firearm 100 in a known manner or a laser sight that also projects a light image onto the point of aim of the firearm 100 in a known manner.

To remove the sight mounting plate 200-600, with or without the sight 712 remaining attached, the set screw 704 or other threaded coupling device can be loosened on the threaded aperture 522 to reduce the force on the alignment pin 702. The alignment pin 702 can then be pushed out of the alignment pin cavity 532 through one of the alignment pin receiving apertures 520, 521. The sight mounting plate 200-600 may then be slidably decoupled from the slide 102 by slidably removing the mounting rail 116 from the mounting slot 524 in a direction opposite the direction in which they were attached.

Though the disclosed example includes a particular arrangement of a number of parts, components, features, and aspects, the disclosure is not limited to only that example or arrangement. Any one or more of the parts, components, features, and aspects of the disclosure can be employed alone or in other arrangements of any two or more of the same.

Although certain firearm, sight, and sight attachment plate features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A firearm comprising:

a frame;

a barrel;

an accessory mounting area comprising a mounting rail; and an accessory mounting plate removably coupled to the accessory mounting area, the accessory mounting plate comprising a mounting slot disposed along a bottom side of the accessory mounting plate and configured to slidably receive at least a portion of the mounting rail therein, wherein the mounting rail gradually widens from a breech end of the firearm towards a muzzle end of the firearm, wherein the accessory mounting plate further comprises: an alignment pin cavity in fluid communication with the mounting slot and extending from a first side to an opposing second side of the mounting plate, wherein the alignment pin cavity is configured to receive an alignment pin therein; and a first threaded aperture disposed adjacent a front wall of the accessory mounting plate, wherein the threaded aperture is in fluid communication with the alignment pin cavity and the mounting slot.

2. The firearm of claim 1, wherein the accessory mounting area is disposed on one of the frame and the barrel.

3. The firearm of claim 1, further comprising a slide operable to move along the frame, wherein the accessory mounting area is disposed on the slide.

4. The firearm of claim 1, wherein the accessory mounting plate further comprises:

an alignment pin disposed in the alignment pin cavity;

a threaded coupling device disposed within the first threaded aperture;

wherein a bottom end of the threaded coupling device contacts the alignment pin.

5. The firearm of claim 1, wherein the accessory mounting plate further comprises:

an accessory mounting surface disposed along a top side of the accessory mounting plate; and at least one second threaded aperture disposed through the accessory mounting surface.

6. The firearm of claim 5, further comprising a sight removably coupled to the accessory mounting surface.

7. The firearm of claim 1, wherein the accessory mounting plate further comprises a plurality of mounting projections extending up from a top surface of the accessory mounting surface.

8. The firearm of claim 1, wherein the accessory mounting plate further comprises a fixed sight fixedly coupled to the accessory mounting plate and disposed adjacent one of a front wall and a rear wall of the accessory mounting plate.

9. The firearm of claim 1, wherein the accessory mounting plate is slidably coupled to the mounting rail from a breech end of the firearm.

10. The firearm of claim 1, wherein the firearm is one of a pistol, a rifle, a shotgun, or a revolver.

11. An accessory mounting plate for a firearm comprising:

a top side;

an opposing bottom side;

a mounting slot disposed along a bottom surface of the accessory mounting plate and configured to slidably receive at least a portion of a mounting rail from the firearm therein; and an accessory mounting surface disposed along the top side and configured to receive a removable sight thereon, wherein the mounting rail gradually widens from a breech end of the firearm towards a muzzle end of the firearm, wherein the accessory mounting plate further comprises: an alignment pin cavity in fluid communication with the mounting slot and extending from a first side to an opposing second side of the mounting plate, wherein the alignment pin cavity is configured to receive an alignment pin therein; and a first threaded aperture disposed adjacent a front wall of the accessory mounting plate, wherein the threaded aperture is in fluid communication with the alignment pin cavity and the mounting slot.

12. The accessory mounting plate of claim 11, further comprising a plurality of mounting projections extending up from a top surface of the accessory mounting surface.

13. A method of attaching a sight to a firearm comprising:

providing the firearm comprising:

a frame;

a barrel; and a sight plate mounting area comprising a mounting rail comprising a front wall and an opposing rear wall;

providing a sight mounting plate comprising:

a front wall;

an opposing rear wall;

a first side wall;

a second side wall;

a bottom side comprising a mounting slot; and a top side comprising:

a sight mounting surface;

a sight removably coupled to the sight mounting surface; and a first threaded aperture extending from the top side to the bottom side and in fluid communication with the mounting slot;

an alignment pin cavity extending from the first side wall to the second side wall the alignment pin cavity comprising an inner wall;

slidably coupling the sight mounting plate to the sight plate mounting area;

inserting an alignment pin into the alignment pin cavity; and threadably coupling a threaded coupling device into the first threaded aperture, wherein the threaded coupling device contacts the alignment pin and forces the alignment pin between the inner wall of the alignment pin cavity and one of the front wall and the rear wall of the mounting rail.

14. The method of claim 13, wherein slidably coupling the sight mounting plate to the sight plate mounting area comprises slidably inserting the mounting rail into the mounting slot.

15. The method of claim 14, wherein the sight mounting plate is slidably coupled to the sight plate mounting area by sliding the sight mounting plate in a direction of a breech end of the firearm towards a muzzle end of the firearm.

16. The method of claim 15, wherein forcing the alignment pin between the front wall of the mounting rail and the inner wall of the alignment pin cavity further moves the sight mounting plate towards the muzzle end of the firearm and raises at least a portion of the sight mounting plate against the mounting rail.

* * * * *